US007274898B2

(12) United States Patent
Nousho et al.

(10) Patent No.: US 7,274,898 B2
(45) Date of Patent: Sep. 25, 2007

(54) PROCESS CARTRIDGE, IMAGE FORMING METHOD, AND IMAGE FORMING APPARATUS

(75) Inventors: Shinji Nousho, Numazu (JP); Hideo Nakamori, Numazu (JP); Keisuke Shimoyama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 197 days.

(21) Appl. No.: 11/224,984

(22) Filed: Sep. 14, 2005

(65) Prior Publication Data

US 2006/0062595 A1 Mar. 23, 2006

(30) Foreign Application Priority Data

Sep. 15, 2004 (JP) ..... 2004-269021

(51) Int. Cl.
*G03G 15/00* (2006.01)

(52) U.S. Cl. ..... 399/159

(58) Field of Classification Search ..... 399/159; 430/126

See application file for complete search history.

(56) References Cited

U.S. PATENT DOCUMENTS 5,008,172 A 4/1991 Rokutanzono et al.
5,147,751 A 9/1992 Kojima et al.
5,342,718 A 8/1994 Nousho et al.
5,991,573 A 11/1999 Nohsho et al.
6,060,205 A * 5/2000 Takeichi et al. ..... 430/126
6,295,438 B1 9/2001 Fujishiro et al.
6,816,691 B2 11/2004 Kabata et al.
6,879,799 B2 4/2005 Nohsho et al.
7,177,570 B2 * 2/2007 Nagame et al. ..... 399/159
2005/0026058 A1 2/2005 Kami et al.
2005/0047804 A1 * 3/2005 Kosuge ..... 399/27

(Continued)

FOREIGN PATENT DOCUMENTS

EP 0 715 230 A1 6/1996

(Continued)

OTHER PUBLICATIONS

U.S. Appl. No. 11/224,984, filed Sep. 14, 2005, Nousho, et al.

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus having a latent electrostatic image bearing member, a metal-containing compound adhesion unit, a latent electrostatic image forming unit, a developing unit, a transferring unit, a fixing unit, and a cleaning unit, in which the rate of variability in the content of metallic atoms in the metal-containing compound adhered on the surface of the latent electrostatic image bearing member, represented by the following equation, is 10% to 70%, Rate of variability=(W2/W1)×100, in which W1 represents the content of metallic atoms in the metal-containing compound according to XPS immediately after the metal-containing compound adhered on the surface of the latent electrostatic image bearing member, and W2 represents the content of metallic atoms in the metal-containing compound adhered on the surface of the latent electrostatic image bearing member according to XPS after 100 sheets of paper are continuously printed using the image forming apparatus.

18 Claims, 9 Drawing Sheets

U.S. PATENT DOCUMENTS

| | | | |
|---|---|---|---|
| 2005/0053853 | A1 | 3/2005 | Sugino et al. |
| 2005/0118518 | A1 | 6/2005 | Ikegami et al. |

FOREIGN PATENT DOCUMENTS

| | | | |
|---|---|---|---|
| EP | 1 391 787 | A1 | 2/2004 |
| JP | 1-170951 | | 7/1989 |
| JP | 6-324603 | | 11/1994 |
| JP | 2859646 | | 12/1998 |
| JP | 2000-162881 | | 6/2000 |

OTHER PUBLICATIONS

U.S. Appl. No. 11/487,573, filed Jul. 17, 2006, Nakamori.

* cited by examiner

PROCESS CARTRIDGE, IMAGE FORMING METHOD, AND IMAGE FORMING APPARATUS

BACKGROUND OF THE INVENTION

1. Field of the Invention

The present invention relates to a process cartridge, an image forming method, and an image forming apparatus, all of which are suitably used for electrophotography, electrographic recording methods, and electrostatic printing methods, and the like.

2. Description of the Related Art

For latent electrostatic image bearing members (hereinafter, may be referred to as photoconductor, or electrographic photoconductor) used for electrophotography which is widely used for copiers, printers, and the like, organic photoconductive materials have been generally used so far from the perspective of advantages such as low-cost operation, mass production, and no pollution. However, there are some problems with organic photoconductors, because anti-abrasion and durability of organic photoconductors are inferior to those of inorganic photoconductors.

In recent years, full-color images and high-speed processing of electrophotographic systems have been demanded, and tandem-type full-color image forming apparatuses providing with individual photoconductors for each color toner have been put to practical use. To downsize the tandem-type full-color image forming apparatus, diameter of the photoconductor must be made smaller. For this reason, further improvements in mechanical durability of photoconductors which are primarily represented by anti-abrasion of photoconductors, have become strongly requested.

For a method for improving anti-abrasion of organic photoconductors, for example, an organic photoconductor with a protective layer containing a filler which comprises metal or a metallic oxide provided thereon have been disclosed in Japanese Patent Application Laid-Open (JP-A) No. 01-170951. Except of the method for improving anti-abrasion of a photoconductor itself by providing the protective layer to the surface of the photoconductor, a method for reducing the surface energy of a photoconductor by applying a lubricant to the surface of a photoconductor has been known in the art. For a method for supplying a lubricant to the surface of a photoconductor, for example, there have been proposed a method for applying a solid lubricant using a coating unit such as a brush which is disclosed in Japanese Patent Application Laid-Open (JP-A) No. 2000-162881, a method for supplying a lubricant to the surface of a photoconductor by adding the lubricant to toner as an external additive, which is disclosed in Japanese Patent (JP-B) No. 2859646, and the like. In addition, by reducing surface energy of a photoconductor through the use of a lubricant, it is also possible not only to reduce abrasion of photoconductor but also to improve transferring rate and prevent occurrence of abnormal images such as transferring omissions.

It is also possible to reduce abrasion of a photoconductor by coating a metal-containing compound on the surface of a photoconductor by means of a metal-containing coating unit to reduce surface energy of the photoconductor and protect the photoconductor from strong charging hazards such as AC charge.

However, there are some problems with an image forming apparatus which comprises the metal-containing compound coating unit as shown below: (1) when a charge roller is used in combination with the metal-containing compound coating method for use, there is no problem involved initially, however, with the lapse of time, smear of metal-containing compound occurs on the charge roller, causing charge non-uniformity and resulting in abnormal images. (2) when a metallic soap is used as the metal-containing compound in combination with a toner having small particle diameter, there is no problem involved initially, however, with the lapse of time, abrasion of blade edge according to blade cleaning methos considerably increases, resulting in degraded cleaning durability.

Accordingly, in an image forming apparatus which comprises a metal-containing compound adhesion unit configured to make a metal-containing compound adhere on the surface of a latent electrostatic image bearing member, an image forming apparatus enabling preventing smear on the charge roller, reducing abrasion of blade edge and forming excellent images in stable conditions and relevant techniques thereof have not yet been presented so far, and there are demands for quickly providing such an image forming apparatus.

SUMMARY OF THE INVENTION

It is therefore an object of the present invention to provide an image forming apparatus and a process cartridge enabling preventing smear on charge roller, reducing abrasion of blade edge to form excellent images in stable conditions in an image forming apparatus equipped with a metal-containing compound adhesion unit configured to make a metal-containing compound adhere on the surface of a latent electrostatic image bearing member and to provide the image forming method using the image forming apparatus and the process cartridge.

To solve these problems, as a result of keen examinations provided by the inventors of the present invention, it is found that a coating method of a metal-containing compound and coating conditions can be precisely set by more precisely measuring and evaluating the content of metallic atoms in the metal-containing compound to achieve preventing smear on the charge roller and reduction in the amount of blade abrasion while reducing surface energy of the latent electrostatic image bearing member and protecting the latent electrostatic image bearing member from charging hazard, although the adhesive amount of a metal-containing compound coated on the surface of a latent electrostatic image bearing member has been estimated by the consumed amount of the metal-containing compound so far.

An image forming apparatus according to the present invention comprises a latent electrostatic image bearing member, a metal-containing compound adhesion unit configured to make a metal-containing compound adhere on the surface of the latent electrostatic image bearing member, a latent electrostatic image forming unit configured to form a latent electrostatic image on the surface of the latent electrostatic image bearing member, a developing unit configured to develop the latent electrostatic image using a toner to form a visible image, a transferring unit configured to transfer the visible image onto a recording medium, a fixing unit configured to fix the transferred image on the recording medium, and a cleaning unit configured to clean a residual toner on the latent electrostatic image bearing member, in which the rate of variability in the content of metallic atoms in the metal-containing compound adhered on the surface of the latent electrostatic image bearing member which is represented by the following Equation 1 is 10% to 70%.

$$\text{Rate of variability}=(W2/W1)\times 100 \qquad \text{Equation 1}$$

However, in Equation 1, W1 represents the content of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content of metallic atoms in the metal-containing compound adhered on the surface of the latent electrostatic image bearing member according to x-ray photoelectron spectroscopy (XPS) after 100 sheets of paper are continuously printed through the use of an image forming apparatus.

In the image forming apparatus of the present invention, the metal-containing compound adhesion unit makes a metal-containing compound adhere on the surface of the latent electrostatic image bearing member, the latent electrostatic image forming unit forms a latent electrostatic image on the latent electrostatic image bearing member, the developing unit develops the latent electrostatic image using a toner to form a visible image, the transferring unit transfers the visible image onto a recording medium, and the fixing unit fixes the transferred image on the recording medium. As a result, it is possible to form excellent images in stable conditions while preventing smear on the charge roller and reducing abrasion of blade edge in an image forming apparatus which comprises an adhesion unit for making a metal-containing compound adhere on the surface of the photoconductor.

An image forming method of the present invention comprises making a metal-containing compound adhere on the surface of a latent electrostatic image bearing member, forming a latent electrostatic image on the surface of the latent electrostatic image bearing member, developing the latent electrostatic image using a toner to form a visible image, transferring the visible image onto a recording medium, fixing the transferred image on the recording medium, and cleaning a residual toner on the latent electrostatic image bearing member, in which the rate of variability in the content of metallic atoms in the metal-containing compound adhered on the surface of the latent electrostatic image bearing member which is represented by the following Equation 1 is 10% to 70%.

$$\text{Rate of variability}=(W2/W1)\times 100 \qquad \text{Equation 1}$$

However, in Equation 1, W1 represents the content (atomic %) of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content (atomic %) of metallic atoms in the metal-containing compound adhered on the surface of the latent electrostatic image bearing member according to x-ray photoelectron spectroscopy (XPS) after 100 sheets of paper are continuously printed through the use of an image forming apparatus.

In the image forming method of the present invention, a metal-containing compound adheres to the surface of a latent electrostatic image bearing member in the making a metal-containing compound adhere on the surface of a latent electrostatic image bearing member, a latent image is formed on the latent electrostatic image bearing member in the forming of a latent electrostatic image, the latent electrostatic image is developed using a toner to form a visible image in the developing, the visible image is transferred onto a recording medium in the transferring, the transferred image on the recording medium is fixed in the fixing. As a result, it is possible to form excellent images in stable conditions while preventing smear on the charge roller and reducing abrasion of blade edge in an image forming apparatus which comprises a metal-containing compound adhesion unit configured to make a metal-containing compound adhere on the surface of the latent electrostatic image bearing member.

A process cartridge of the present invention comprises a latent electrostatic image bearing member, and a metal-containing compound adhesion unit configured to make a metal-containing compound adhere on the surface of the latent electrostatic image bearing member, and at least one selected from a charger, a developing unit, a transferring unit, and a cleaning unit, in which the rate of variability of the content of metallic atoms in the metal-containing compound adhered on the surface of the latent electrostatic image bearing member which is represented by the following Equation 1 is 10% to 70%.

$$\text{Rate of variability}=(W2/W1)\times 100 \qquad \text{Equation 1}$$

However, in Equation 1, W1 represents the content (atomic %) of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content (atomic %) of metallic atoms in the metal-containing compound adhered on the surface of the latent electrostatic image bearing member according to x-ray photoelectron spectroscopy after 100 sheets of paper are continuously printed through the use of an image forming apparatus.

A process cartridge according to the present invention is detachably mounted to an image forming apparatus, has excellence in convenience and cleaning ability and enables forming high-quality of image with high image density.

DESCRIPTION OF THE PREFERRED EMBODIMENTS (Image Forming Method and Image Forming Apparatus)

An image forming apparatus of the present invention comprises a latent electrostatic image bearing member, a metal-containing compound adhesion unit, a latent electrostatic image forming unit, a developing unit, a transferring unit, a fixing unit, and a cleaning unit and further comprises other units suitably selected in accordance with the necessity, for example, a charge eliminating unit, a recycling unit, and a controlling unit.

An image forming method according to the present invention comprises forming a latent electrostatic image, making a metal-containing compound adhere on the surface of a latent electrostatic image bearing member, developing, transferring, fixing, and cleaning and further comprises other steps suitably selected in accordance with the necessity, for example, charge-eliminating, recycling, and controlling.

The image forming method of the present invention can be suitably carried out by using an image forming apparatus of the present invention, the making a metal-containing compound adhere on the surface of a latent electrostatic image bearing member can be carried out by using the metal-containing compound adhesion unit, the forming a latent electrostatic image can be carried out by the latent electrostatic image forming unit, the developing can be carried out by the developing unit, the transferring can be carried out by the transferring unit, the fixing can be carried out by the fixing unit, and other steps stated above can be carried out by other units.

The processing speed of the image-forming apparatus is preferably 200 mm/s or more.

Adhesion of Metal-Containing Compound and Metal-Containing Compound Adhesion Unit The making a metal-containing compound adhere on the surface of a latent electrostatic image bearing member is a step for making a metal-containing compound adhere on a surface of a latent electrostatic image bearing member. The making a metal-containing compound adhere on the surface of a latent electrostatic image bearing member is carried out by the metal-containing compound adhesion unit.

Figure 1:
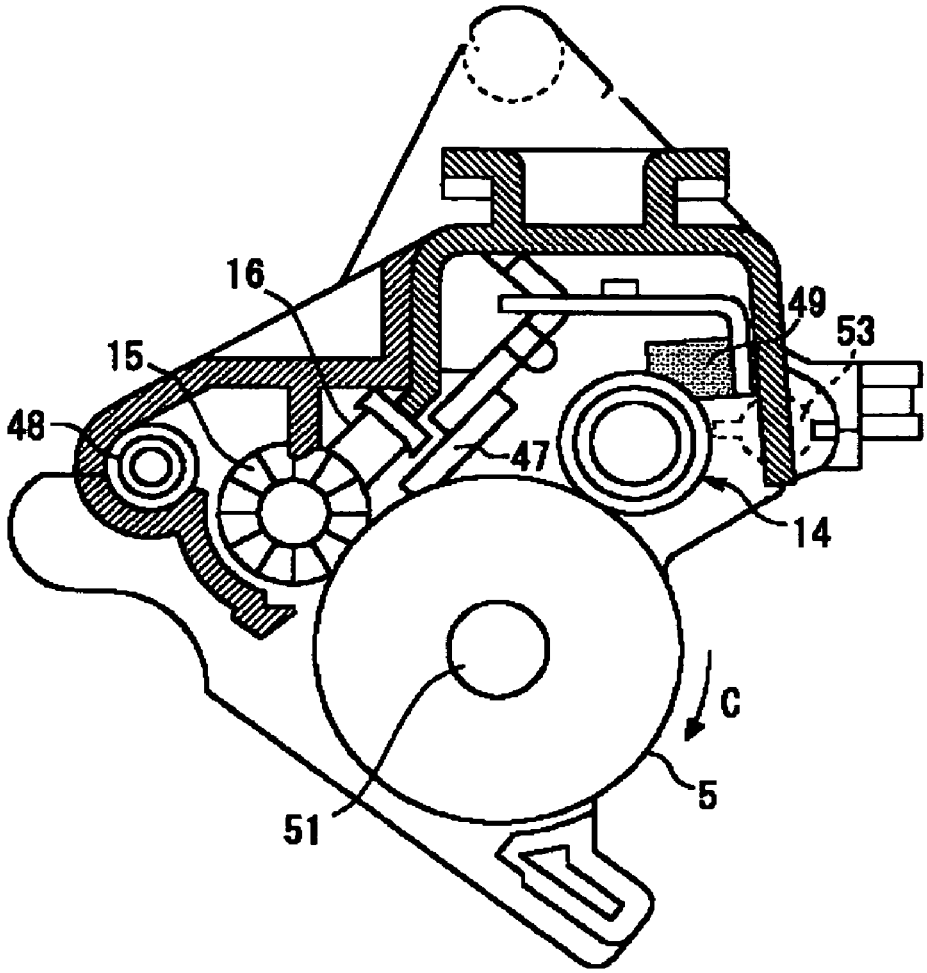
FIG. 1 is a cross-sectional view schematically showing an example of a metal-containing compound adhesion unit used for an image forming apparatus of the present invention.

The metal-containing compound adhesion unit is not particularly limited, may be suitably selected from those in the art in accordance with the intended use, and preferred examples thereof include a brush roller which is arranged such that a metal-containing compound can adhere on the surface of the latent electrostatic image bearing member while supplying the metal-containing compound thereto, and a metal-containing compound adhesion unit shown in FIG. 1.

In the present invention, the rate of variability in the content of metallic atoms in a metal-containing compound adhered on the surface of the latent electrostatic image bearing member which is represented by the following Equation 1 is preferably 10% to 70%, and more preferably 20% to 40%.

When the rate of variability is less than 10%, abrasion of blade edge may increase, and when the rate of variability is more than 70%, the charge roller may be smeared.

$$\text{Rate of variability}=(W2/W1)\times 100 \qquad \text{Equation 1}$$

However, in Equation 1, W1 represents the content (atomic %) of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content (atomic %) of metallic atoms in the metal-containing compound adhered on the surface of the latent electrostatic image bearing member according to x-ray photoelectron spectroscopy (XPS) after 100 sheets of paper are continuously printed through the use of an image forming apparatus.

The metal-containing compound is a metallic salt having coordination number 2 being straight chain fatty acids, and the content of metallic atoms in the metallic salt having coordination number 2 being straight chain fatty acids adhered on the surface of the latent electrostatic image bearing member after 100 sheets of paper are continuously printed through the use of an image forming apparatus is preferably 0.3 atomic % to 2.0 atomic %, more preferably 0.3% atomic % to 1.5 atomic %, and still more preferably 0.6 atomic % to 1.2 atomic %. For the metallic salt having coordination number 2 being straight chain fatty acids, for example, zinc stearates are preferably used.

For the method for measuring the content of metallic atoms in the metal-containing compound adhered on the surface of the latent electrostatic image bearing member, for example, there are a method for directly observing the coated thickness by means of, for example, the scanning transmission electron microscopy (STEM), and a method using the x-ray photoelectron spectroscopy (XPS), of which a method using the x-ray photoelectron spectroscopy (XPS) is particularly preferable.

In the x-ray photoelectron spectroscopy, an x-ray photoelectron spectrometer (1600S-type, manufactured by Philips Electronics N.V.) is used, and for an x-ray source, MgKα (100 W) is used for an analysis region of 0.8 mm×2.0 mm. For the calculation of the atomic percentage of the surface of the latent electrostatic image bearing member, relative sensitivity factor supplied by Philips Electronics N.V. is used. For the atomic percentage, the content of metallic atoms in the metal-containing compound can be obtained as the ratio of atomic percentage of the elements excluding hydrogen and helium .

The region where the metallic atoms exist on the surface of the latent electrostatic image bearing member is not particularly limited and may be suitably selected in accordance with the intended use, however, it is preferably a surface layer formed in approx. several nanometers measured from the surface of the latent electrostatic image bearing member, and more preferably a surface layer formed in zero nanometer to 10 nanometers measured from the surface of the latent electrostatic image bearing member.

The image forming apparatus is preferably the one that is based on a tandem-type intermediate image transferring technique in which a plurality of image forming elements are arranged, each of image forming elements comprises a latent electrostatic image bearing member, a metal-containing compound adhesion unit configured to make a metal-containing compound adhere on the surface of the latent electrostatic image bearing member, a latent electrostatic image forming unit configured to form a latent electrostatic image on the surface of the latent electrostatic image bearing member, a developing unit configured to develop the latent electrostatic image using a toner to form a visible image, and a transferring unit configured to transfer the visible image onto an intermediate transfer member to thereby superimpose a plurality of toner images on the intermediate transfer member.

Preferably, the image forming apparatus employing the tandem-type intermediate image transferring comprises a metal-containing compound adhesion unit for an intermediate transfer member configured to make a metal-containing compound adhere on the surface of the intermediate transfer member, and the content of metallic atoms in the metal-containing compound adhered to the surface of the intermediate transfer member is less than that of metallic atoms in the metal-containing compound adhered to the surface of the latent electrostatic image bearing member.

The metal-containing compound is not particularly limited, may be suitably selected in accordance with the intended use, and examples thereof include alkaline metal salts of higher fatty acids, metallic soaps, and metal-containing compounds other than metallic soaps.

Examples of the alkaline metal salts of higher fatty acids include sodium laureate having 12 carbon atoms and a content of metallic atoms by XPS of 6.7 atomic %; potassium laureate having 12 carbon atoms and a content of metallic atoms by XPS of 6.7 atomic %; sodium myristate having 14 carbon atoms and a content of metallic atoms by XPS of 5.9 atomic %; potassium myristate having 14 carbon atoms and a content of metallic atoms by XPS of 5.9 atomic %; sodium palmitate having 16 carbon atoms and a content of metallic atoms by XPS of 5.3 atomic %; potassium palmitate having 16 carbon atoms and a content of metallic atoms by XPS of 5.3 atomic %; sodium stearate having 18 carbon atoms and a content of metallic atoms by XPS of 4.8 atomic %; and potassium stearate having 18 carbon atoms and a content of metallic atoms by XPS of 4.8 atomic %.

The metallic soaps are determined by both fatty acids and metallic atoms constituting each of the metallic soaps and have chemical properties of physical properties relating to hydrophobic bonds between fatty acid molecules and physical properties of polar bonds of metallic atoms relating to intermetallic bonds. Preferred examples thereof are metallic salts of straight chain fatty acids; metallic salts of branched fatty acids; metallic salts of monoene unsaturated fatty acids and diene unsaturated fatty acids having double bonds within a molecule; and metallic salts of oxygen fatty acids. The carbon atom number of the fatty acids is preferably 3 to 29, and more preferably 12 to 18 for the purpose of facilitating low-surface energy.

Examples of metals in the metallic soaps include copper, beryllium, magnesium, calcium, strontium, barium, zinc, cadmium, aluminum, cerium, titanium, zirconium, lead, chrome, manganese, cobalt, and nickel, of which those having coordination number 2 are preferable, and metallic atoms having a wide contact angle such as barium, aluminum and zinc are particularly preferable.

Examples of the metallic slats of the straight chain unsaturated fatty acids include calcium butanoate having 4 carbon atoms and a content of metallic atoms by XPS of 7.7 atomic %; barium hexanoate having 6 carbon atoms and a content of metallic atoms by XPS of 5.9 atomic %; zinc octanoate having 8 carbon atoms and a content of metallic atoms by XPS of 4.8 atomic %; titanium nonanoate having 9 carbon atoms and a content of metallic atoms by XPS of 8.3 atomic %; zinc decanoate having 10 carbon atoms and a content of metallic atoms by XPS of 4.0 atomic %; barium undecanoate having 11 carbon atoms and a content of metallic atoms by XPS of 3.7 atomic %; calcium laurate having 12 carbon atoms and a content of metallic atoms by XPS of 3.4 atomic %; zinc myristate having 14 carbon atoms and a content of metallic atoms by XPS of 3.0 atomic %; calcium palmitate having 16 carbon atoms and a content of metallic atoms by XPS of 2.7 atomic %; zinc stearate having 18 carbon atoms and a content of metallic atoms by XPS of 2.4 atomic %; copper stearate having 18 carbon atoms and a content of metallic atoms by XPS of 2.4 atomic %; titanium stearate having 18 carbon atoms and a content of metallic atoms by XPS of 1.2 atomic %; aluminum stearate having 18 carbon atoms and a content of metallic atoms by XPS of 1.6 atomic %; aluminum arachidate having 20 carbon atoms and a content of metallic atoms by XPS of 1.5 atomic %; manganese behenate having 22 carbon atoms and a content of metallic atoms by XPS of 2.0 atomic %; zinc lignocerate having 24 carbon atoms and a content of metallic atoms by XPS of 1.9 atomic %; calcium cerotinate having 25 carbon atoms and a content of metallic atoms by XPS of 1.8 atomic %; aluminum montanate having 28 carbon atoms and a content of metallic atoms by XPS of 1.1 atomic %; and manganese melissicate having 30 carbon atoms and a content of metallic atoms by XPS of 1.6 atomic %.

Examples of the metallic salts of branched fatty acids include 2-ethyl hexanoate aluminum having 8 carbon atoms and a content of metallic atoms by XPS of 3.2 atomic %; lithium iso-octanoate having 8 carbon atoms and a content of metallic atoms by XPS of 9.1 atomic %; titanium iso-nonanoate having 9 carbon atoms and a content of metallic atoms by XPS of 2.2 atomic %; strontium iso-decanoate having 10 carbon atoms and a content of metallic atoms by XPS of 2.2 atomic %; calcium iso-tridecanoate having 13 carbon atoms and a content of metallic atoms by XPS of 3.2 atomic %; zinc iso-palmitate having 16 carbon atoms and a content of metallic atoms by XPS of 2.7 atomic %; and zinc iso-stearate having 18 carbon atoms and a content of metallic atoms by XPS of 2.4 atomic %.

Examples of the metallic salts of monoene unsaturated fatty acids and diene unsaturated fatty acids having double bonds within a molecule include zinc physeterate having 14 carbon atoms and a content of metallic atoms by XPS of 3.0 atomic %; calcium myristolate having 14 carbon atoms and a content of metallic atoms by XPS of 3.0 atomic %; zinc palmitolate having 16 carbon atoms and a content of metallic atoms by XPS of 2.7 atomic %; manganese oleate having 18 carbon atoms and a content of metallic atoms by XPS of 2.4 atomic %; and aluminum gadoleate having 20 carbon atoms and a content of metallic atoms by XPS of 1.5 atomic %.

Examples of the oxygen fatty acids include zinc-sabinate having 12 carbon atoms and a content of metallic atoms by XPS of 3.2 atomic %; calcium-ipurolate having 14 carbon atoms and a content of metallic atoms by XPS of 2.9 atomic %; aluminum ricinoleate having 18 carbon atoms and a content of metallic atoms by XPS of 1.6 atomic %; and barium-kamlolenate having 18 carbon atoms and a content of metallic atoms by XPS of 2.3 atomic %.

The metal-containing compounds other than the metallic soaps are as follows:

(1) Molybdenum Dithiocarbamate Dialkyl Sulfide

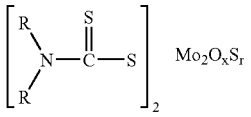

Molybdenum Dithiocarbamate
(MODTC)
Trade name: Molyban A

The Mo content of molybdenum dithiocarbamate by XPS is 6.9 atomic %.

(2) Oxymolybdenum Dithiophosphate Dialkyl Sulfide

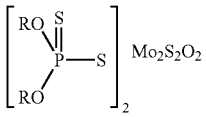

Molybdenum Dithiophoshate
(MODTP)
Trade name: Molyban L

The Mo content of oxymolybdenum dialkyl dithiophosphate by XPS is 7.1 atomic %.

(3) Titanium Dialkyl Dithiophosphate

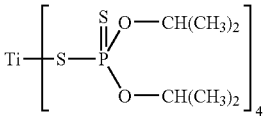

The Mo content of titanium dialkyl dithiophosphate by XPS is 3.0 atomic %.

(4) N,N'-zinc ethylenebis(dithiocarbamate)

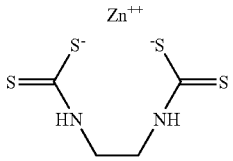

The Zn content of titanium dialkyl dithiophosphate by XPS is 14.3 atomic %.

(5) Antimony Dithiocarbamate

The Zn content of antimony dithiocarbamate by XPS is 14.2 atomic %.

(6) Polyhydroxy Titanium Stearate $[(Ti(OCOC_{17}H_{35})—O)_n]$

The Zn content of Polyhydroxy titanium stearate by XPS is 4.8 atomic %.

Next, the metal-containing compound adhesion unit configured to make a metal-containing compound adhere on the surface of the latent electrostatic image bearing member will be described with reference to drawings.

As shown FIG. 1, brush roller 15 serving as a metal-containing compound adhesion unit configured to make a metal-containing compound as a lubricant adhere on the surface of latent electrostatic image bearing member or photoconductor 5 is arranged so as to make contact with metal-containing compound 16 as well. A portion of metal-containing compound 16 scratched and taken by rotating action of brush roller 15 is transported and supplied to the latent electrostatic image bearing member 5 by rotating action of the brush roller 15.

In FIG. 1, reference numbers 47 and 14 represent a cleaning blade and a charger, respectively.

For the metal-containing compound adhesion unit, a plurality of the metal-containing compound adhesion units can be arranged on the latent electrostatic image bearing member 5. By arranging a plurality of the metal-containing compound adhesion units, the metal-containing compound 16 can be supplied steadily, and anti-abrasion of the latent electrostatic image bearing member 5 can be enhanced, and excellent quality of images can be obtained over a long period of time in stable conditions.

For the metal-containing compound 16 to be coated on the latent electrostatic image bearing member 5 with the brush roller 15, it is preferred to use the same substance as the metal-containing compound to be added to the toner as an external additive, and examples thereof include metal-containing compounds each of which metallic salts of fatty acids such as zinc stearate are melted and solidified and then processed in a rod-shape. The metal-containing compound 16 is fixed by a holding member with an adhesive and a two-sided pressure sensitive adhesive tape to be arranged so as to make contact with the brush roller 15. When the material of the metal-containing compound to be added to the toner as an external additive differs from that of the metal-containing compound 16 supplied from the brush roller 15, it causes abnormality in toner charge amount distribution or the like due to frictional charge between the respective materials and the toner and carrier, which may cause abnormality of images such as black void printed on recording media.

Preferably, the image forming apparatus of the present invention further comprises a metal-containing compound adhesive amount adjusting unit. By providing with the metal-containing compound adhesive amount adjusting unit, it is possible to prevent excessive coating of the metal-containing compound 16 on the surface of the latent electrostatic image bearing member 5 as well as to reduce the consumption amount of the metal-containing compound 16 and to prolong the operating life thereof. The supplied amount of the metal-containing compound added as an external additive to the toner is affected by the image area. When an image having a high-image area is formed and a large amount of toner is consumed, the supplied amount of the metal-containing compound 16 also increases. When an image having a low-image area is formed and a small amount of toner is consumed, the supplied amount of the metal-containing compound is also small. Particularly, in a tandem-type image forming apparatus, since it is not uncommon that areas of images respectively formed by respective latent electrostatic image bearing members 5 substantially differs from each other, the adhesive amount of the metal-containing compound may substantially differ from one latent electrostatic image bearing member 5 to another when left as they are.

With respect to the metal-containing compound adhesive amount adjusting unit, for the latent electrostatic image bearing member 5 having a small number of pixels, the amount of the metal-containing compound 16 supplied to each latent electrostatic image bearing member 5 can be appropriately adjusted by counting the number of pixels of input data and controlling the image forming apparatus such that the contact time of the metal-containing compound 16 with the brush roller 15 is prolonged. For the latent electrostatic image bearing member 5 where an image having a low-image area is formed with a reduced amount of the metal-containing compound 16 required to be supplied from toner, the supplied amount of the metal-containing compound 16 to the latent electrostatic image bearing member 5 can be constantly kept in good conditions by controlling the image forming apparatus such that the supplied amount of the metal-containing compound from a coating unit is increased. The metal-containing compound adhesive amount adjusting unit is not limited to the above-mentioned units. The metal-containing compound adhesive amount adjusting unit may be the one that detects variations such as toner density of a developer and the amount of toner in a toner container to adjust the amount of the metal-containing compound 16 so as to be appropriately supplied to the latent electrostatic image bearing member 5.

In the present invention, the amount of the metal-containing compound to be transferred to the surface of the latent electrostatic image bearing member 5 is preferably controlled by changing the load of a brush roller 15 to the metal-containing compound 16 and the revolutions per minute of the brush roller 15.

The load of the brush roller 15 to the metal-containing compound 16 is preferably 1 g/cm$^2$ to 10 g/cm$^2$. The revolutions per minute of brush roller 15 is preferably 50 rpm to 1,000 rpm.

Latent Electrostatic Image Forming Unit and Latent Electrostatic Image Forming

The latent electrostatic image forming unit comprises a charger configured to uniformly charge the surface of a latent electrostatic image bearing member and an exposer configured to expose the charged surface of the latent electrostatic image bearing member to form a latent electrostatic image on the latent electrostatic image bearing member.

The latent electrostatic image bearing member is not particularly limited as to the material, shape, structure, size, and the like, may be suitably selected from those known in the art, however, with respect to the shape, a photoconductor formed in a drum shape is preferably used.

The latent electrostatic image bearing member used in the present invention comprises a substrate and a least a photoconductive layer formed on the substrate and further comprises other layers in accordance with the necessity.

With respect to the latent electrostatic image bearing member, a first latent electrostatic image bearing member comprises a substrate and a one-layered photoconductive layer on the substrate and further comprises an intermediate layer, a protective layer, and other layers in accordance with the necessity, which may be hereinafter referred to as one-layered photoconductor. A second latent electrostatic image bearing member comprises a substrate and a photoconductive layer in which at least an electric charge generating layer and an electric charge transporting layer are formed in this order on the substrate, and further comprises an intermediate layer, a protective layer, and other layers in accordance with the necessity, which may be hereinafter referred to as laminar-structured photoconductor. In the second latent electrostatic image bearing member, namely, a laminar-structured photoconductor, the electric charge generating layer and the electric charge transporting may be disposed in a reversed order.

In addition, preferably, an outermost surface layer of the latent electrostatic image bearing member comprises inorganic fine particles, a binder resin, and an electric charge transporting agent. The outermost surface layer is not particularly limited, provided that it is a layer disposed outermost of the surface of the latent electrostatic image bearing member, may be suitably selected in accordance with the intended use. In a one-layered photoconductive layer, the outermost surface layer means a photoconductor itself or a surface protective layer. In a laminar structured photoconductive layer, the outermost surface layer means an electric charge transporting layer or a surface protective layer.

Figure 2:
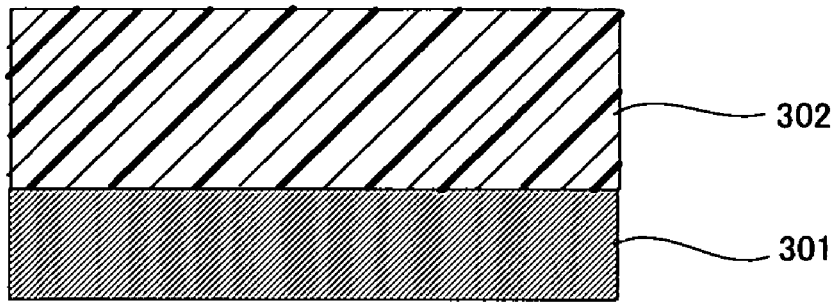
FIG. 2 is a cross-sectional view schematically showing an example of the latent electrostatic image bearing member of the present invention.
Figure 3:
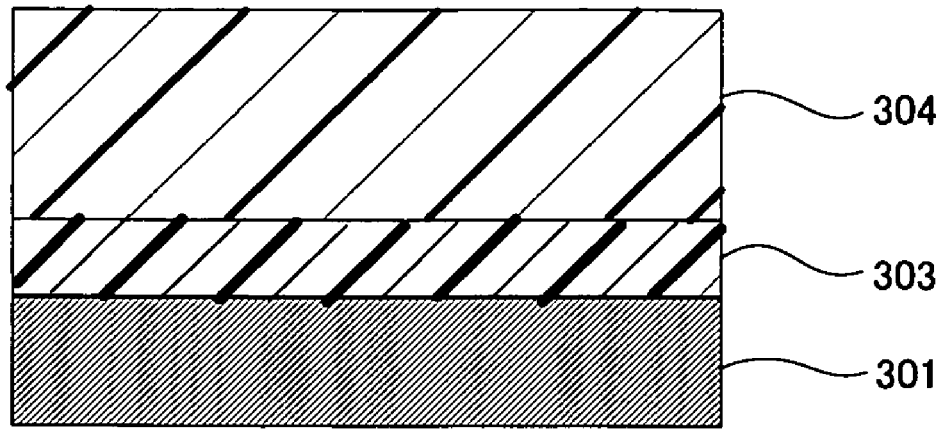
FIG. 3 is a cross-sectional view schematically showing another example of the latent electrostatic image bearing member of the present invention.
Figure 4:
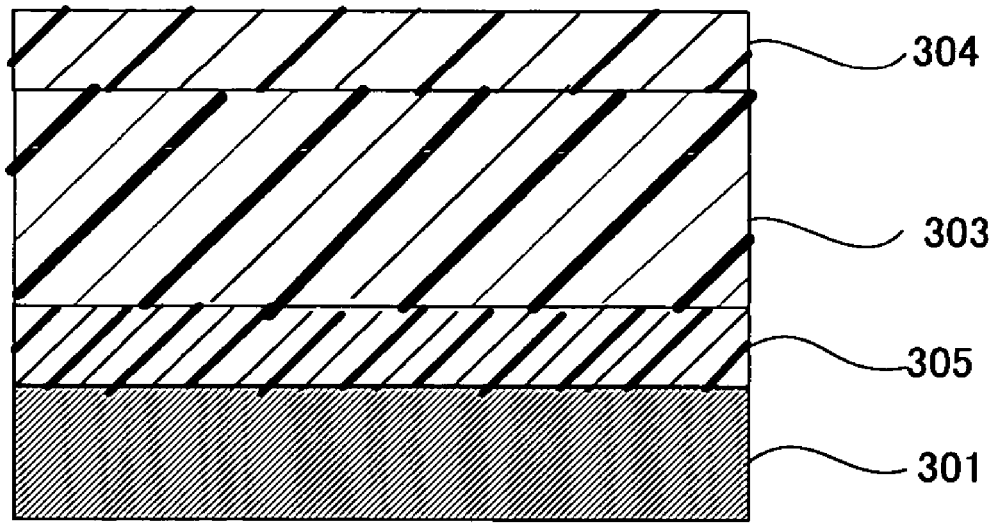
FIG. 4 is a cross-sectional view schematically showing a still another example of the latent electrostatic image bearing member of the present invention.
Figure 5:
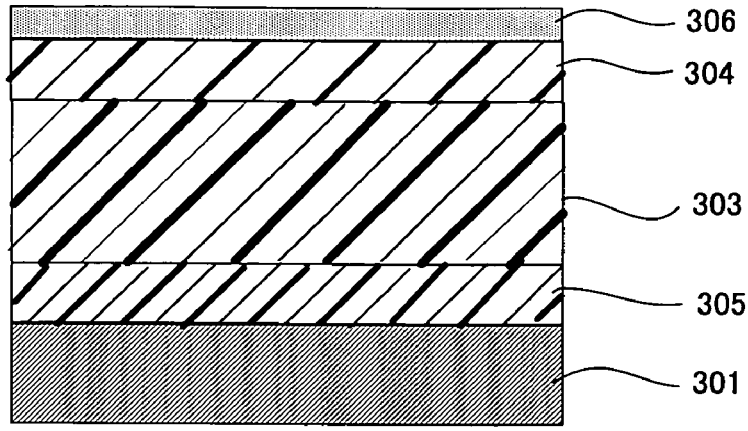
FIG. 5 is a cross-sectional view schematically showing a still further example of the latent electrostatic image bearing member of the present invention.

Herein, FIG. 2 is a cross-sectional view schematically showing the latent electrostatic image bearing member and represents a photoconductor having a structure in which photoconductive layer 302 is disposed on substrate 301. FIGS. 3, 4, and 5 respectively show examples of other structures of the photoconductor of the present invention. FIG. 3 shows a functionally-separated type of photoconductor in which photoconductive layer 302 comprises electric charge generating layer 303 and electric charge transporting layer 304. FIG. 4 shows a photoconductor having a structure in which under-coating layer 305 is disposed between substrate 301 and functionally-separated type of photoconductor. FIG. 5 shows a photoconductor in which surface protective layer 306 is further formed on the photoconductive layer 302 shown in FIG. 4. For the photoconductor relating to the present invention, other layers other than those stated above may be formed, provided that the photoconductor has at least a photoconductive layer on the substrate, and this type of photoconductor may comprise each of these layers in combination with two or more arbitrarily.

Substrate

The substrate is not particularly limited and may be suitably selected in accordance with the intended use, however, those exhibiting conductivity with volume resistance of $10^{10}$ Ω·cm or less are preferable.

The substrate is not particularly limited as to material, shape, and size, and with respect to the shape, any of plate-like substrates, drum-like substrates, or belt-like substrates can be used. For example, it is possible to use film-like plastic, cylindrical plastic or paper sheet coated with a metal such as aluminum, nickel, chrome, nichrome, copper, gold, silver, and platinum; metallic oxides such as tin oxides, and indium oxides by depositing or sputtering; plates such as aluminum, aluminum alloy, nickel, and stainless; or tubes obtained by subjecting the above-noted plates to element tubing by means of techniques such as extrusion and drawing and then subjecting to surface treatments such as cutting, super-finishing, and grinding. The endless nickel belt and the endless stainless belt disclosed in Japanese Patent Application Laid-Open (JP-A) No. 52-36016 can be also used.

Other than the above stated, it is also possible to use those in which conductive fine particles are dispersed in a proper binder resin and coated on the substrate to form a conductive layer.

Examples of materials of the conductive fine particles include carbon black, acetylene black, metallic powers such as aluminum, nickel, iron, nichrome, copper, zinc, and silver, or conductive tin oxides, and metallic oxide fine particles such as ITO. Examples of the binder resin include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinylidene chloride resins, polyarylate resins, phenoxy resins, polycarbonates, cellulose acetate, ethyl cellulose resins, polyvinyl butyral resins, polyvinyl formal resins, polyvinyl toluene resins, poly-N-vinylcarbazole resins, acryl resins, silicone resins, epoxy resins, melamine resins, urethane resins, phenol resins, and alkyd resins.

The conductive layer can be formed as follows. First, the conductive fine particles and the resin are dissolved and dispersed in a solvent to prepare a coating solution, and the coating solution is coated to a substrate to thereby form the conductive layer. Examples of the solvent include tetrahydrofuran, dichloromethane, methyl ethyl keton, and toluene.

Those are preferably used which comprises a conductive layer formed on the cylindrical substrate using a heat-shrinkable tube in which the conductive fine particles are included in a resin such as a polyvinyl chloride resin, a polypropylene resin, a polyester resin, a polystyrene resin, a polyvinylidene chloride resin, a polyethylene resin, a chlorinated rubber, a polytetrafloro ethylene fluorine resin.

Photoconductive Layer

The types and the materials of the photoconductive layer used for the latent electrostatic image bearing member include inorganic photoconductors which comprises a compound such as a crystalline selenium compound, an amorphous-selenium compound, a selenium-tellurium compound, a selenium-tellurium-halogen compound, and a selenium-arsenic compound; and organic photoconductors (OPC) which comprises a substance such as polysilane and phthalopolymethine, of which organic photoconductors (OPC) are particularly preferable because they are environmentally-friendly and low-priced.

As described above, the photoconductive layer may be one-layered one or laminar-structured one. Hereinafter, both types of photoconductive layers will be described separately.

<Laminar-Structured Photosensitive Layer>

The laminar-structured photoconductive layer comprises a photoconductive layer which comprises a substrate and at least an electric charge generating layer and an electric charge transporting layer disposed on the substrate and further comprises an intermediate layer, a surface protective layer, and other layers in accordance with the necessity.

The electric charge generating layer essentially comprises an electric charge substance, comprises a binder resin, and further comprises other components in accordance with the necessity.

For the electric charge generating substance, any of inorganic materials and organic materials can be used.

Examples of the inorganic materials include crystalline selenium compounds, amorphous-selenium compounds, selenium-tellurium compounds, selenium-tellurium-halogen compounds, and selenium-arsenic compounds.

The organic materials are not particularly limited, may be suitably selected from those known in the art, and examples of the organic materials include phthalocyanine pigments such as metallic phthalocyanine and metal-free phthalocyanine; azlenium slat pigments, squaric acid methyne pigments, azo pigments having a carbazole skeleton; azo pigments having a triphenylamine skeleton; azo pigments having a diphenylamine skeleton; azo pigments having a dibenzothiophene skeleton; azo pigments having a fluorenon skeleton; azo pigments having an oxadiazole skeleton; azo pigments having a bisstilbene skeleton; azo pigments having a distyryl oxadiazole skeleton; azo pigments having a distyryl carbazole skeleton; perylene pigments; anthraquinone or polycyclic quinine pigments; quinoneimine pigments; diphenylmethane and triphenylmethane pigments; benzoquinone and naphtoquinone pigments; cyanine and azomethine pigments; indigoid pigments; and bisbenzimidazole pigments. Each of these pigments may be used alone or in combination with two or more.

Preferred examples of the binder resin include polyamide resins, polyurethane resins, epoxy resins, polyketone resins, polycarbonate resins, silicone resins, acryl resins, polyvinyl butyrals, polyvinyl formals, polyvinyl ketones, polystyrenes, polyvinyl-N-carbazoles, and polyacrylamines. Each of these resins may be used alone or in combination with two or more.

For other components stated above, electric charge transporting substances may be added to the electric charge generating layer. In addition, as a binder resin of the electric charge generating layer, high-molecular electric charge transporting substances are preferably used besides the binder resins stated above.

For the method for forming the electric charge generating layer, there are the vacuum thin layer forming method and the casting method using a solution dispersion system.

Examples of the vacuum thin layer forming method include glow discharge polymerization, vacuum evaporation, chemical vapor deposition, sputtering, reactive sputtering, ion-plating, and acceleration ion-injection. By means of these vacuum thin layer forming methods, it is possible to excellently form the inorganic materials and organic materials.

To form the electric charge generating layer by the casting method, it can be formed by dispersing the above-noted inorganic or organic electric charge substances along with a binder resin when necessary in a solvent of tetrahydrofuran, cyclohexanone, dioxane, dichloroethane, butanone, and the like using a ball mill, an Atlighter, sand mill, and the like, diluting the dispersion liquid appropriately, and coating the dispersion liquid. The dispersion liquid can be coated by commonly used methods such as dip coating, spray coating, and bead coating.

The thickness of the electric charge generating layer is preferably 0.01 μm to 5 μm, and more preferably 0.05 μm to 2 μm.

The electric charge transporting layer is formed for the purpose of retaining electric charge and combining the retained electric charge with electric charge generated and isolated from the electric charge generating layer by transferring the electric charge generated and isolated from the electric charge generating layer by exposing thereto. To achieve the purpose of retaining electric charge, high electric resistance is required. To achieve the purpose of obtaining high surface potential with retained electric charge, it is required that the dielectric constant be low and the electric charge mobility be excellent.

The electric charge transporting layer comprises an electric charge transporting substance, and a binder resin used in accordance with the necessity. The electric charge transporting layer can be formed by dissolving and dispersing the electric charge transporting substance and the binder resin in an appropriate solvent, coating and drying the dispersion liquid.

As the electric charge transporting substances, there are electron transporting substances and hole transporting substances.

Examples of the electron transporting substances include electron receptive substances such as chloranil, bromanil, tetracyanoethylene, tetracyanoquinodimethane, 2, 4, 7,-trinitro-9-fluorenone, 2, 4, 5, 7-tetranitro-9-fluorenone, 2, 4, 5, 7-tetranitroxanthone, 2, 4, 8-trinitro thioxanthone, 2, 6, 8-trinitro-4H-indeno [1,2-b]thiophene-4-one, 1, 3, 7-trinitrodibenzothiophene-5,5-oxide. Each of these electron transporting substances may be used alone or in combination with two or more.

Examples of the hole transporting substances include oxazole derivatives, oxadiazole derivatives, imidazole derivatives, triphenylamine derivatives, 9-(p-diethylaminostyrilanthracene), 1, 1-bis-(4-dibenzylaminophenyl) propane, styrilanthracene, styril pyrazoline, phenylhydrazones, α-phenyl stilbene derivatives, thiazole derivatives, triazole derivatives, phenazine derivatives, acridine derivatives, benzofuran derivatives, benzimidazole derivatives, and thiophene derivatives. Each of these hole transporting substances may be used alone or in combination with two or more.

For the high-molecular electric charge transporting substances, compounds having structures as described below can also be used.

(a) Examples of polymers having a carbazole ring include polyvinyl-N-carbazole, and compounds described in Japanese Patent Application Laid-Open (JP-A) Nos. 50-82056, 54-9632, 54-11737, 04-175337, 04-183719, and 06-234841.

(b) Examples of polymers having a hydrazone structure include compounds described in Japanese Patent Application Laid-Open (JP-A) Nos. 57-78402, 61-20953, 61-296358, 01-134456, 01-179164, 03-180851, 03-180852, 03-005055, 05-310904, and 06-234840.

(c) Examples of polysilylene polymers include compounds described in Japanese Patent Application Laid-Open (JP-A) Nos. 63-285552, 01-88461, 04-264130, 04-264131, 04-264132, 04-264133, and 04-289867.

(d) Examples of polymers having a triarylamine structure include N,N-bis-(4-methylphenyl)-4-aminopolystylene, and compounds described in Japanese Patent Application Laid-Open (JP-A) Nos. 01-134457, 02-282264, 02-304456, 04-133065, 04-133066, 05-040350, and 05-202135.

(e) Examples of other polymers include formaldehyde polycondensation products of nitropyrene, and compounds described in Japanese Patent Application Laid-Open (JP-A) Nos. 51-73888, 56-150749, 06-234836, and 06-234837.

For polymers having an electron-releasing group used in the present invention, it is possible to use not only the above-noted polymers but also copolymers of monomers known in the art, block polymers, graft polymers, star polymers, and cross-linked polymers having an electron-releasing group such as a cross-linked polymer disclosed in JP-A No. 03-109406.

Examples of the high-molecular electric charge transporting substances include polycarbonates, polyurethanes, polyesters, and polyesters all of which have a triarylamine structure which are much more useful as an electric charge transporting substance, for example, compounds described in Japanese Patent Application Laid-Open (JP-A) Nos. 64-001728, 64-013061, 64-019049, 04-11627, 04-225014, 04-230767, 04-320420, 05-232727, 07-56374, 09-127713, 09-211877, and 09-304956.

Examples of binder resins used in the electric charge transporting layer include polycarbonate resins, polyester resins, methacrylic resins, acryl resins, polyethylene resins, vinyl chloride resins, vinyl acetates, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, and phenoxy resins. Each of these resins may be used alone or in combination of two or more.

Besides the electric charge transporting substances and the binder resins, additives such as plasticizers, antioidants, leveling agents can be further added to the electric charge transporting layer in moderate amount in accordance with the necessity.

For the leveling agents, for example, silicone oils such as dimethyl silicone oils and methylphenyl silicone oils; polymers having a perfluoroalkyl group in side chain or oligomers are used, and the appropriate amount thereof to be used is 0 parts by mass to 1 part by mass relative to 100 parts by mass of the binder resin.

For the coating method of the electric charge transporting layer, it is possible to coat it using commonly used methods such as dip coating, spray coating, and bead coating.

The thickness of the electric charge transporting layer is preferably 5 μm to 100 μm, and electric charge transporting layers are made thinner in response to demands for higher-quality picture in recent years, and to achieve high-quality picture of 1,200 dpi or more, the thickness thereof is preferably 5 μm to 30 μm.

In addition, when the electric charge transporting layer is disposed at the outermost layer of a photoconductor, the electric charge transporting layer includes at least one inorganic fine particles selected from silicon oxides, titanium oxides, and aluminum oxides.

<One-Layered Photoconductive Layer>

The one-layered photoconductive layer comprises a one-layered photoconductive layer on a substrate and further comprises an intermediate layer, a surface protective layer, and other layers in accordance with the necessity.

When a one-layered photoconductive layer is formed by casting method, in most cases, such a one-layered photoconductive layer is formed by dissolving and dispersing an electric charge generating substance, a low-molecular electric charge transporting substance and a high-molecular electric charge transporting substance in an appropriate solvent, coating the solvent to the substrate and drying it. For the electric charge generating substance and the electric charge transporting substances, the above-noted materials can be used.

To the one-layered photoconductive layer, plasticizers and binder resins can be added in accordance with the necessity.

For the binder resin, binder resins named as the examples used for the electric charge transporting layer can be used as they are. Besides, binder resins named as the examples used for the electric charge generating layer may be mixed therewith for use.

When the one-layered photoconductive layer is disposed at the outermost layer of a photoconductor, it includes at least one inorganic fine particles selected from silicon oxides, titanium oxides, and aluminum oxides.

The one-layered photoconductive layer can be formed by the same production method as in the electric charge transporting layer.

The thickness of the one-layered photoconductive layer is not particularly limited, may be suitably selected in accordance with the intended use, and it is appropriately 5 μm to 100 μm.

In the latent electrostatic image bearing member, there may be cases where a surface protective layer is formed on a one-layered photoconductive layer or on an electric charge transporting layer formed as a laminar-structured photoconductive layer.

Examples of materials used for the surface protective layer include resins known in the art such as ABS resins, ACS resins, copolymers of olefin-vinyl monomers, chlorinated polyethers, aryl resins, phenol resins, polyacetals, polyamides, polyamideimides, polyacrylates, polyaryl sulfones, polybutylens, polybutylene terephthalates, polycarbonates, and epoxy resins. Each of these resins may be used alone or in combination with two or more.

When the latent electrostatic image bearing member comprises a surface protective layer, the surface protective layer serves as an outermost layer of the latent electrostatic image bearing member, therefore, it includes at least one inorganic fine particles selected from silicon oxides, titanium oxides, and aluminum oxides. The surface protective layer is disposed primarily for the purpose of separation of functions. In the present invention, the surface protective layer is formed in a relatively thin layer on a photoconductor, therefore, it has a relatively low-impact on electric property of the photoconductor and has advantages that the content thereof can be more increased compared to the case where inorganic fine particles are included into an electric charge layer, and the function of the surface protective layer can be clearly separated from that of the electric charge transporting layer by using formulation specialized in anti-abrasion.

To include electric charge transporting substances in the surface protective layer is very useful in preventing degradation of electric property of the photoconductor, in particular, in preventing degradation of optical sensitivity when repeatedly used, and elevation of residual potential. It is believed that making the surface protective layer have electric charge transporting property as well enables electric charge to smoothly move over the surface of the photoconductor. For the electric charge transporting substances, the same substances used for the electric charge transporting layer can be used.

Further, various additives may be added as materials of the surface protective layer of the latent electrostatic image bearing member relating to the present invention for the purpose of improving lo adhesive property, surface planarity, and chemical stabilities.

The surface protective layer is formed on the photoconductor by means of commonly used methods such as dip coating, spray coating, blade coating, and knife coating. Particularly, dip coating and spray coating are advantageous from the perspective of mass production and quality of coated layer.

The thickness of the surface protective layer is not particularly limited, may be suitably selected in accordance with the intended use, and is preferably 0.1 μm to 15 μm, and more preferably 1 μm to 10 μm.

In addition, an intermediate layer can be formed between the photoconductive layer and the surface protective layer. Typically, binder resins are used as the main component of the intermediate layer. Examples of the binder resins include polyamides, nylons soluble in alcohols, water-soluble polyvinyl butyrals, polyvinyl butyrals, and polyvinyl alcohols. For the method for forming the intermediate layer, as described above, commonly used coating methods are employed. The thickness of the intermediate layer is approx. 0.051 μm to 2 μm.

The latent electrostatic image bearing member or photoconductor of the present invention can be typically applied to electrophotographic systems such as copiers, laser printers, LED printers, and liquid crystal shutter printers, and it can be widely applied further to apparatuses such as for display based on electrophotographic technologies, recording, photo engraving, and facsimiles.

The latent electrostatic image can be formed, for example, by charging the surface of the latent electrostatic image bearing member uniformly and then exposing the surface thereof imagewisely by means of the latent electrostatic image forming unit.

The latent electrostatic image forming unit includes, for example, at least a charger configured to uniformly charge the surface of the latent electrostatic image bearing member, and an exposer configured to exposing the surface of the latent electrostatic image bearing member.

The charging can be performed by applying a voltage to the surface of the latent electrostatic image bearing member through the use of, for example, the charger.

The charger is not particularly limited, may be suitably selected in accordance with the intended use, and examples thereof include contact chargers known in the art, for example, which are equipped with a conductive or semi-conductive roll, a brush, a film, and a rubber blade, and non-contact chargers utilizing corona discharge such as corotoron and scorotoron.

The exposing can be performed by exposing the surface of the latent electrostatic image bearing member imagewisely through the use of, for example, the exposer.

The exposer is not particularly limited, provided that the surface of the latent electrostatic image bearing member which has been charged by the charger can be exposed imagewisely, may be suitably selected in accordance with the intended use, and examples thereof include various types of exposers such as reproducing optical systems, rod lens array systems, laser optical systems, and liquid crystal shutter optical systems.

In the present invention, the back light method may be employed in which exposing is performed imagewisely from the back side of the latent electrostatic image bearing member.

The image exposing can be performed, when an image forming apparatus is used as a copier and/or a printer, by irradiating reflected light or transmitted light from an original document sheet or by reading the original document using a sensor, converting the information to signals, and scanning the information by a laser beam in accordance with the signals, driving of LED arrays, or drying of liquid crystal shutter arrays to irradiate light to the latent electrostatic image bearing member.

Developing and Developing Unit

The developing is a step for developing the latent electrostatic image using the toner and the developer to form a visible image.

The visible image can be formed by developing the latent electrostatic image using, for example, the toner and the developer, by means of the developing unit.

The developing unit is not particularly limited, provided that latent electrostatic images can be developed using a toner and a developer, may be suitably selected from those in the art, and preferred examples thereof include the one having at least an image developing apparatus which houses the toner and the developer therein and enables supplying the toner and the developer in contact or in non-contact therewith.

In the image developing apparatus, typically dry-developing process is employed. The image developing apparatus may be an image developing apparatus for monochrome color or multi-colors. Preferred examples thereof include the one having a stirrer by which the toner and the developer are rubbed and stirred to be charged, and a rotatable magnet roller.

In the image developing apparatus, for example, the toner and the developer are mixed and stirred, the toner is charged by frictional force at that time to be held in the state where the toner is standing on the surface of the rotating magnet roller to thereby form a magnetic brush. Since the magnet roller is arranged near the latent electrostatic image bearing member, part of the toner constituting the magnetic brush formed on the surface of the magnet roller moves to the surface of the latent electrostatic image bearing member by electric attraction force. As a result, the latent electrostatic image is developed by the toner to form a visible image according to the toner on the surface of the latent electrostatic image bearing member.

The developer to be housed in the image developing apparatus is a developer which comprises the toner, however, the developer may be a one-component developer or a two-component developer.

Transferring and Transferring Unit

The transferring is a step for transferring the visible image onto a recording medium, and it is preferably an aspect in which an intermediate transfer member is used, the visible image is primarily transferred to the intermediate transfer member and then the visible image is secondarily transferred to the recording medium. More preferably, it is an aspect of the transferring in which two or more colors are used, preferably a full-color toner is used, and the aspect comprises a primary transferring in which the visible image is transferred onto an intermediate transfer member to form a composite transfer image and a secondary transferring in which the composite transfer image is transferred onto a recording medium.

The transferring can be performed by charging the visible image using a transfer-charger to charge the surface of the latent electrostatic image bearing member, and it is possible by means of the transferring unit. For the transferring unit, it is preferably an aspect which comprises a primary transferring unit configured to transfer the visible image onto an intermediate transfer member to form to a composite transfer image, and a secondary transferring unit configured to transfer the composite transfer image onto a recording medium.

The intermediate transfer member is not particularly limited, may be suitably selected from those in the art in accordance with the intended use, and preferred examples thereof include transferring belts.

The transferring unit, i.e. the primary transferring unit and the secondary transferring unit, preferably comprise a transferring unit configured to separate the visible image formed on the latent electrostatic image bearing member to the recording medium to be charged. For the transferring unit, there may be one transferring unit or two or more transferring units.

Examples of the transferring unit include corona transferring units by means of corona discharge, transferring belts, transfer rollers, pressure transfer rollers, and adhesion transferring units.

The recording medium is typically standard paper, however, it is not particularly limited, provided that unfixed image after developing can be transferred thereto, may be suitably selected in accordance with the intended use, and media such as PET base for OHP can also be used.

Fixing and Fixing Unit

The fixing is a step for fixing a visible image transferred onto a recording medium using an image fixing apparatus and may be performed every time each individual color toners is transferred onto the recording medium or at a time in the condition where each individual color toners has been superimposed.

The image fixing apparatus is not particularly limited, may be suitably selected in accordance with the intended use, and heat and pressure units known in the art are preferably used. Examples of the heat and pressure units include a combination of a heat roller and a pressure roller, and a combination of a heat roller, a pressure roller, and an endless belt.

The heating temperature in the heat and pressure unit is preferably 80° C. to 200° C.

In the present invention, for example, optical fixing units known in the art may be used along with or instead of the fixing and the fixing unit.

Cleaning and Cleaning Unit

The cleaning is a step for removing a residual toner on the latent electrostatic image bearing member using a cleaning unit.

Examples of the cleaning unit include cleaning blades, magnetic brush cleaners, electrostatic brush cleaners, magnetic roller cleaners, blade cleaners, brush cleaners, and web cleaners.

For the cleaning unit, it is preferably that a plurality of cleaning units are arranged near the surface of the latent electrostatic image bearing member, and the metal-containing compound adhesion unit is arranged at the lower position of at least one cleaning unit.

Figure 6:
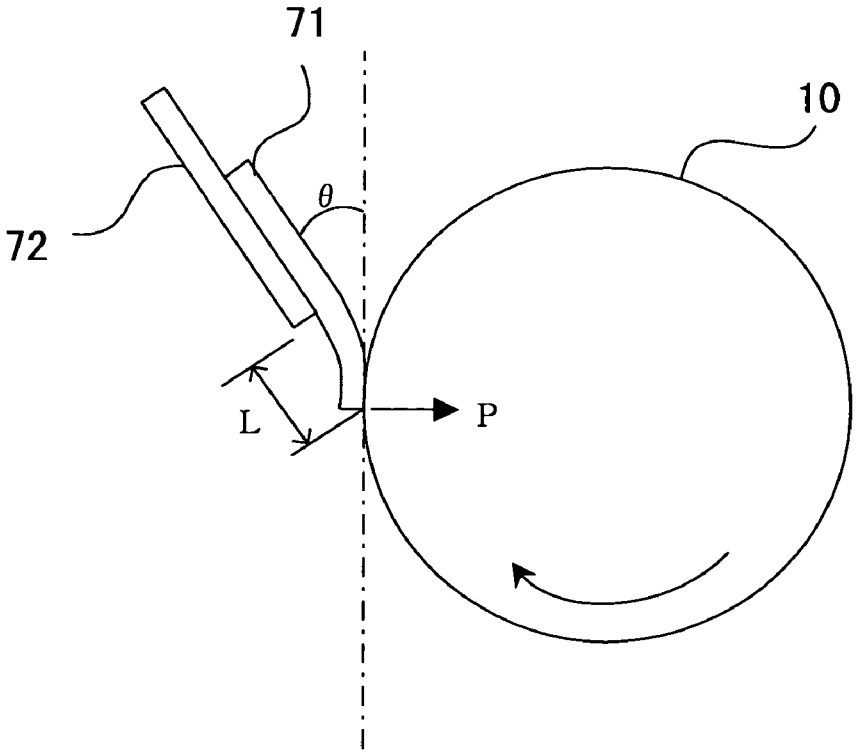
FIG. 6 is a schematic illustration showing an example of a cleaning unit used for the image forming apparatus of the present invention.

Hereinafter, the cleaning unit will be described. FIG. 6 is a cross-sectional view schematically showing the cleaning mechanism used for the present invention. In the present invention, cleaning conditions and blade materials known in the art can be used. When a cleaning unit having such a mechanism is used, it is preferred to use it in a direction counter to the rotation of the latent electrostatic image bearing member in contact with the latent electrostatic image bearing member.

In FIG. 6, contact load P is a vector value in a normal direction of pressure contact force when cleaning blade 71 is made contact with latent electrostatic image bearing member or photoconductor 10. The contact angle θ is an angle formed between the tangent line in the contact point where the photoconductor 10 makes contact with the cleaning blade 71 and the cleaning blade 71 before deformation thereof. In addition, free length L of the cleaning blade 71 represents a length from the edge of bearing member 72 to the end of the cleaning blade 71 before deformation thereof. The value of the contact load P of the cleaning blade 71 to the photoconductor 10 is preferably 5 g/cm to 50 g/cm. The value of the contact angle θ is preferably 5° to 35°. The free length L of the cleaning blade 71 is preferably 3 mm to 15 mm, and the thickness of the cleaning blade 71 is preferably 0.5 mm to 10 mm.

Examples of materials of rubber blades used for the blade cleaning method include urethane rubbers, silicone rubbers, fluorine rubbers, chloroprene rubbers, and butadiene rubbers, of which urethane rubbers are particularly preferable.

In the present invention, counterturn of the cleaning blade can be effectively prevented by concurrently controlling hardness and repulsion elasticity of the rubber blade. The JISA hardness of the rubber blade at a temperature of 25° C.±5° C. is preferably 65 to 80. When the JIS-A hardness is less than 65, counterturn of the cleaning blade may easily occur, and when the JIS-A hardness is more than 80, cleaning performance may degrade. The repulsion elasticity of the blade rubber is preferably 20% to 75%. When the repulsion elasticity is more than 75%, counterturn of the cleaning blade may easily occur, and when the repulsion elasticity is less than 20%, cleaning performance may degrade.

The JIS-A hardness and repulsion elasticity can be measured based on the testing method of vulcanizate physical properties of JIS K6301.

The charge-eliminating is a step for eliminating electricity by applying charge-eliminating bias to the latent electrostatic image bearing member, and it can be suitably performed by means of a charge-eliminating unit.

The charge-eliminating unit is not particularly limited and may be required only to have the ability for applying charge-eliminating bias to the latent electrostatic image bearing member, and may be suitably selected from charge-eliminating units known in the art. For example, a charge-eliminating lamp is preferably used.

The recycling is a step for recycling the color toner for electrophotography eliminated in the cleaning and can be suitably performed by means of a recycling unit.

The recycling unit is not particularly limited, and examples of thereof include transport units known in the art.

The controlling is a step for controlling individual steps described above and can be suitably performed by means of a controlling unit.

The controlling unit is not particularly limited, provided that it can control movements of the individual units, and may be suitably selected in accordance with the intended use. Examples thereof include equipments such as sequencers and computers.

An aspect of the image forming method of the present invention using the image forming apparatus according to the present invention will be described with reference to FIG. 7.

Image forming apparatus 100 shown in FIG. 7 comprises photoconductor drum, hereinafter it may be referred to as photoconductor 10, serving as the latent electrostatic image bearing member, charge roller 20 serving as the charging unit, exposer 30 serving as the exposing unit, image developing unit 40 serving as the developing unit, intermediate transfer member 50, cleaner 60 serving as the cleaning unit having a cleaning blade, and charge-eliminating lamp 70 serving as the charge-eliminating unit.

The intermediate transfer member 50 is an endless belt and is designed such that the member is spanned over three rollers 51 disposed inside thereof and driven in the direction indicated by an arrow. One of the three rollers 51 also serves as a bias roller for applying a given bias for image transfer i.e. primary transfer bias to the intermediate transfer member 50. Cleaner 90 having a cleaning blade is arranged near the intermediate transfer member 50. Transferring roller 80 as the transferring unit faces the intermediate transfer member 50 and is capable of applying a bias for image transfer for transferring (secondary transferring) of a developed toner image to transferring sheet 95 serving as a final transferring member. Corona charger 58 for applying charges to the developed toner image on the intermediate transfer member 50 is arranged around the intermediate transfer member 50. The corona charger 58 is disposed between a contact area of the photoconductor 10 and the intermediate transfer member 50 and another contact area of the intermediate transfer member 50 and the transferring sheet 95 in the direction of rotation of the intermediate transfer member 50.

The image developing unit 40 includes developing belt 41 as a developer carrier, black developing unit 45K disposed around the developing belt 41, yellow developing unit 45Y, magenta developing unit 45M, and cyan developing unit 45C. The black developing unit 45K includes developer tank 42K, developer feed roller 43K, and developing roller 44K. The yellow developing unit 45Y includes developer tank 42Y, developing feed roller 43Y, and developing roller 44Y. The magenta developing unit 45M includes developer tank 42M, developer feed roller 43M, and developing roller 44M. The cyan developing unit 45 includes developer tank 42C, developer feed roller 43C, and developing roller 44C. The developing belt 41 is in the form of an endless belt and is rotatably spanned over plural belt rollers, a part of which is in contact with the photoconductor 10.

Figure 7:
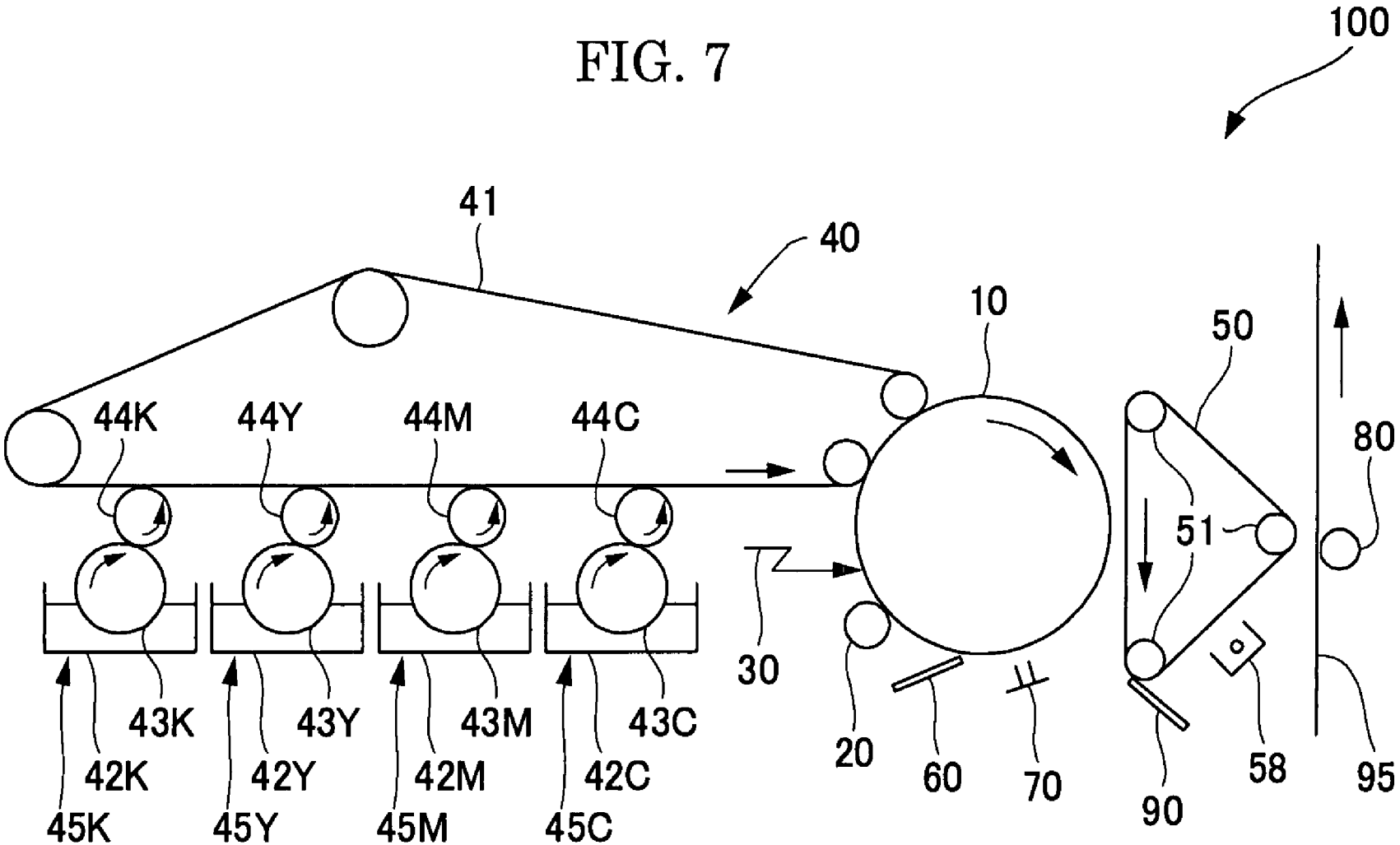
FIG. 7 is a schematic view illustrating an example of the image forming apparatus of the present invention.

In the image forming apparatus shown in FIG. 7, for example, the charge roller 20 uniformly charges the photoconductor drum 10. The exposer 30 exposes the photoconductor drum 10 imagewise to form a latent electrostatic image thereon. The image developing unit 40 feeds the toner to the photoconductor drum 10 to develop the electrostatic latent image thereon to thereby form a visible image i.e. toner image. The visible image is transferred to the intermediate transfer member (primary transferring) and then transferred to the transferring sheet 95 (secondary transferring) by action of a voltage applied by the rollers 51, to thereby form a transferred image on the transferring sheet 95. Untransferred toner on the photoconductor 10 after the transferring is removed by the cleaner 60, followed by elimination of residual charges on the photoconductor 10 by the charge-eliminating lamp 70.

Figure 8:
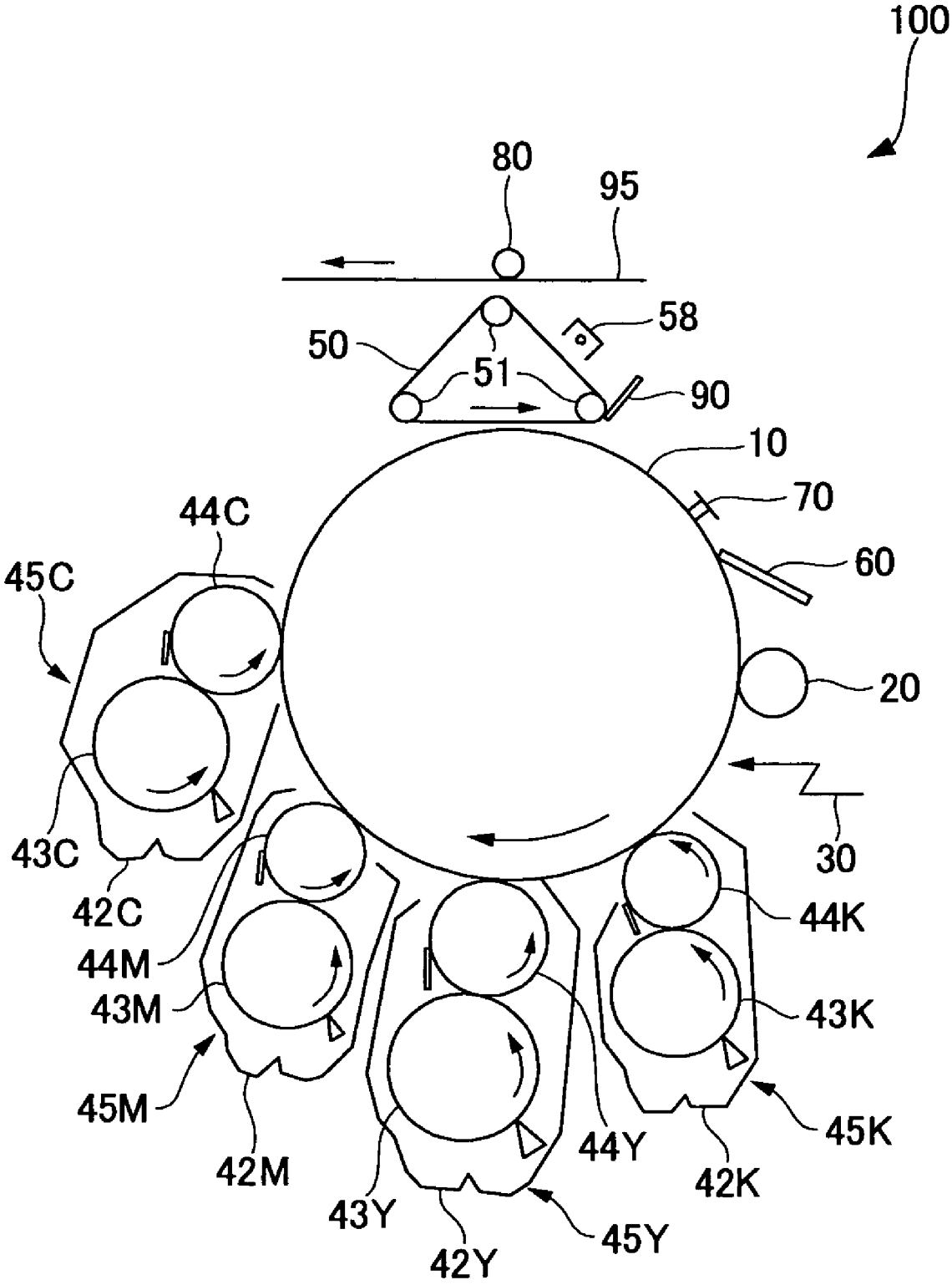
FIG. 8 is a view showing an example of another process using the image forming apparatus of the present invention.

Another aspect of the image forming method using the image forming apparatus will be described with reference to FIG. 8. The image forming apparatus 100 shown in FIG. 8 has the same configuration and the same operational effects as in the image forming apparatus 100 shown in FIG. 7 except that the image forming apparatus 100 of FIG. 8 does not include developing belt 41, and that black developing unit 45K, yellow developing unit 45Y, magenta developing unit 45M, and cyan developing unit 45C surround and face photoconductor 10. The same components are represented with the same reference numbers both in FIG. 7 and FIG. 8.

Figure 9:
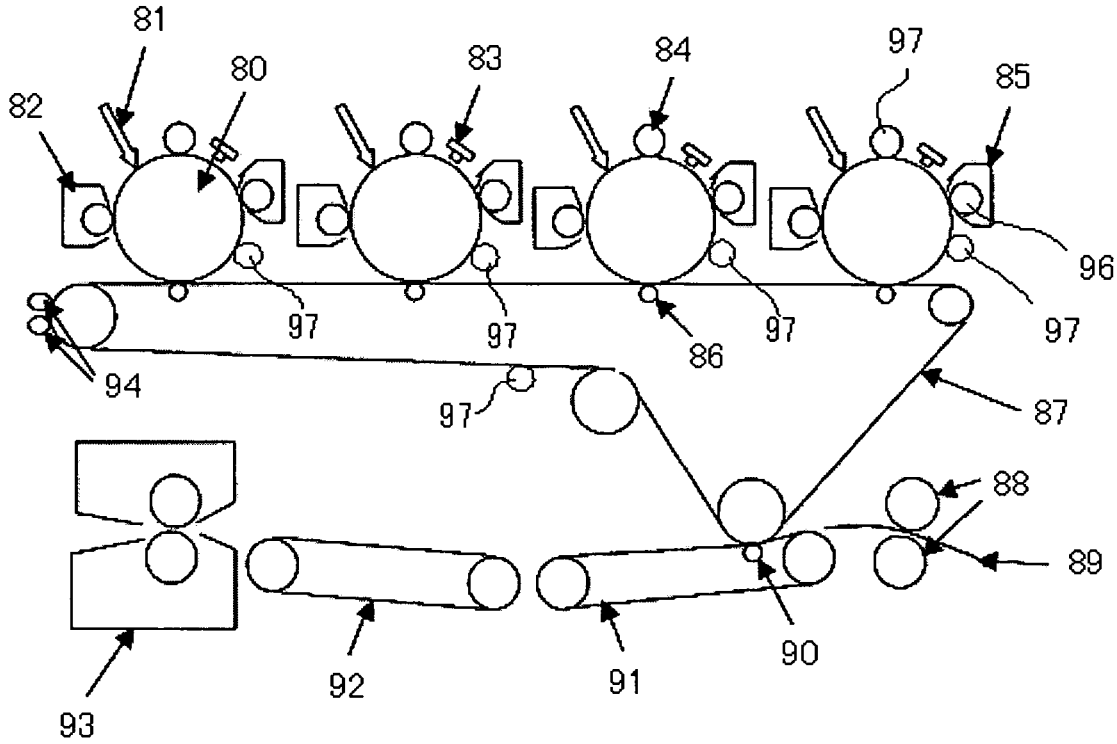
FIG. 9 is a block diagram schematically showing an example of a printer relating to an embodiment of the present invention.

Still another aspect of the image forming method using the image forming apparatus will be described with reference to FIG. 9. Image forming apparatus 100 shown in FIG. 9 is so called a tandem image forming apparatus which includes intermediate transfer belt 87. The image forming apparatus comprises photoconductor drums for each color of 80Y, 80M, 80C, and 80Bk and is not configured to share one photoconductor drum 80 among each of these colors. In addition, the image forming apparatus drum cleaning unit 85, charge-eliminating lamp 83, charge rollers 84 for each of these colors each configured to uniformly charge the photoconductor drum 80 respectively. In this image forming apparatus, the charge rollers 84, two-component developer which is a member for developing (not shown), intermediate transferring belt 97, and metal-containing compound adhesion unit 98 are members making contact with the photoconductor drums 80. A plurality of metal-containing compound adhesion units are arranged behind cleaning units 85.

In an image forming apparatus based on the tandem type intermediate transferring method, there are a plurality of image forming elements arranged, each of which comprises a latent electrostatic image bearing member, a metal containing compound adhesion unit configured to make a metal-containing compound adhere on the surface of a latent electrostatic image bearing member, a latent electrostatic image forming unit configured to form a latent electrostatic image on the surface of the latent electrostatic image bearing member, a developing unit configured to develop the latent electrostatic image using a toner to form a visible image, a transferring unit configured to transfer the visible image onto a recording medium, and a fixing unit configured to fix the transferred image on the recording medium to superimpose a plurality of toner images on an intermediate transfer member to thereby form an image.

Here, it is preferred that the intermediate transfer member comprise a metal-containing compound adhesion unit for the intermediate transfer member configured to make a metal-containing compound adhere on the surface of the intermediate transfer member, and the content of metallic atoms in the metal-containing compound adhered on the surface of the intermediate transfer member be less than that of metallic atoms in the metal-containing compound adhered on the surface of the latent electrostatic image bearing member.

Since the tandem image forming apparatus enables forming latent images for each color in parallel with developing these images, it allows much higher-speeding in image forming than in a revolver image forming apparatus.

Figure 10:
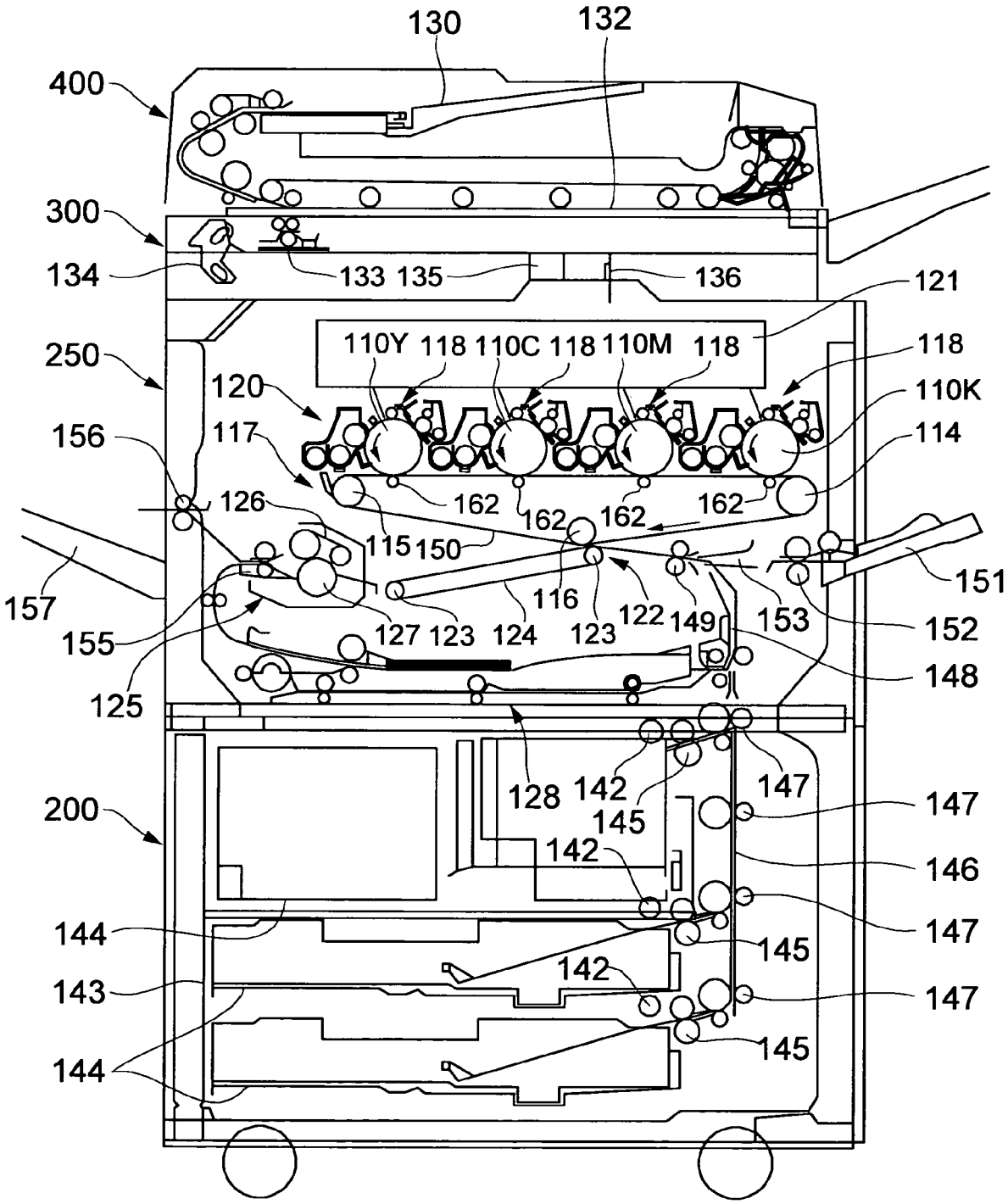
FIG. 10 is a schematic illustration showing an example of performing the image forming method of the present invention using an image forming apparatus, i.e. a tandem-type color image forming apparatus of the present invention.

Here, a tandem type color image forming apparatus will be described in detail. As shown in FIG. 10, the tandem image forming apparatus comprises copier main body 250, feeder table 200, scanner 300, and automatic document feeder (ADF) 400.

The copier main body 250 includes an endless belt intermediate transfer member 150 at its center part. The intermediate transfer member 150 is spanned over three support rollers 114, 115, and 116 and is capable of rotating and moving in a clockwise direction in FIG. 10. An intermediate transfer member cleaner 117 capable of removing a residual toner on the intermediate transfer member 150 is arranged near the support roller 115. Above the intermediate transfer member 150 spanned between the first and second support rollers 114 and 115, yellow, cyan, magenta, and black image forming units 118 are arrayed in parallel in a moving direction of the intermediate transfer member 150 to thereby constitute a tandem image forming apparatus 120. An exposer 121 is arranged near the tandem image forming unit 120. A secondary image transferer 122 faces the tandem image developing apparatus 120 with the interposition of the intermediate transfer member 150. The secondary transferer 122 comprises an endless belt serving as a secondary transferring belt 124 spanned over a pair of rollers 123. The transferring sheet transported on the secondary transferring belt 124 is capable of being in contact with the intermediate transfer member 150. Image fixing apparatus 125 is arranged on the side of the secondary image-transferer 122. The image fixing apparatus 125 comprises fixing belt 126 which is an endless belt, and pressure roller 127 which is arranged to be pressed by the fixing belt 126.

The tandem image forming apparatus further comprises a sheet reverser 128 in the vicinity of the secondary image-transferer 122 and the image fixing apparatus 125. The sheet reverser 128 is capable of reversing the transferring sheet so as to form images on both sides of the transferring sheet.

Next, full-color image forming i.e. color copy using the tandem image forming apparatus will be described below. Initially, a document is placed on document platen 130 of automatic document feeder (ADF) 400. Alternatively, the automatic document feeder (ADF) 400 is opened, a document is placed on contact glass 132 of scanner 300, and the automatic document feeder (ADF) 400 is closed to press the document.

When pushing a start switch (not shown), the document placed on the automatic document feeder 400 is transported onto the contact glass 132. When the document is initially placed on the contact glass 132, the scanner 300 is immediately driven to operate first carriage 133 and second carriage 134. Light is applied from a light source to the document by action of the first carriage 133, and reflected light from the document is further reflected toward the second carriage 134. The reflected light is further reflected by a mirror of the second carriage 134 and passes through image-forming lens 135 into read sensor 136 to thereby read the color image and to produce black, yellow, magenta, and cyan image information.

Figure 11:
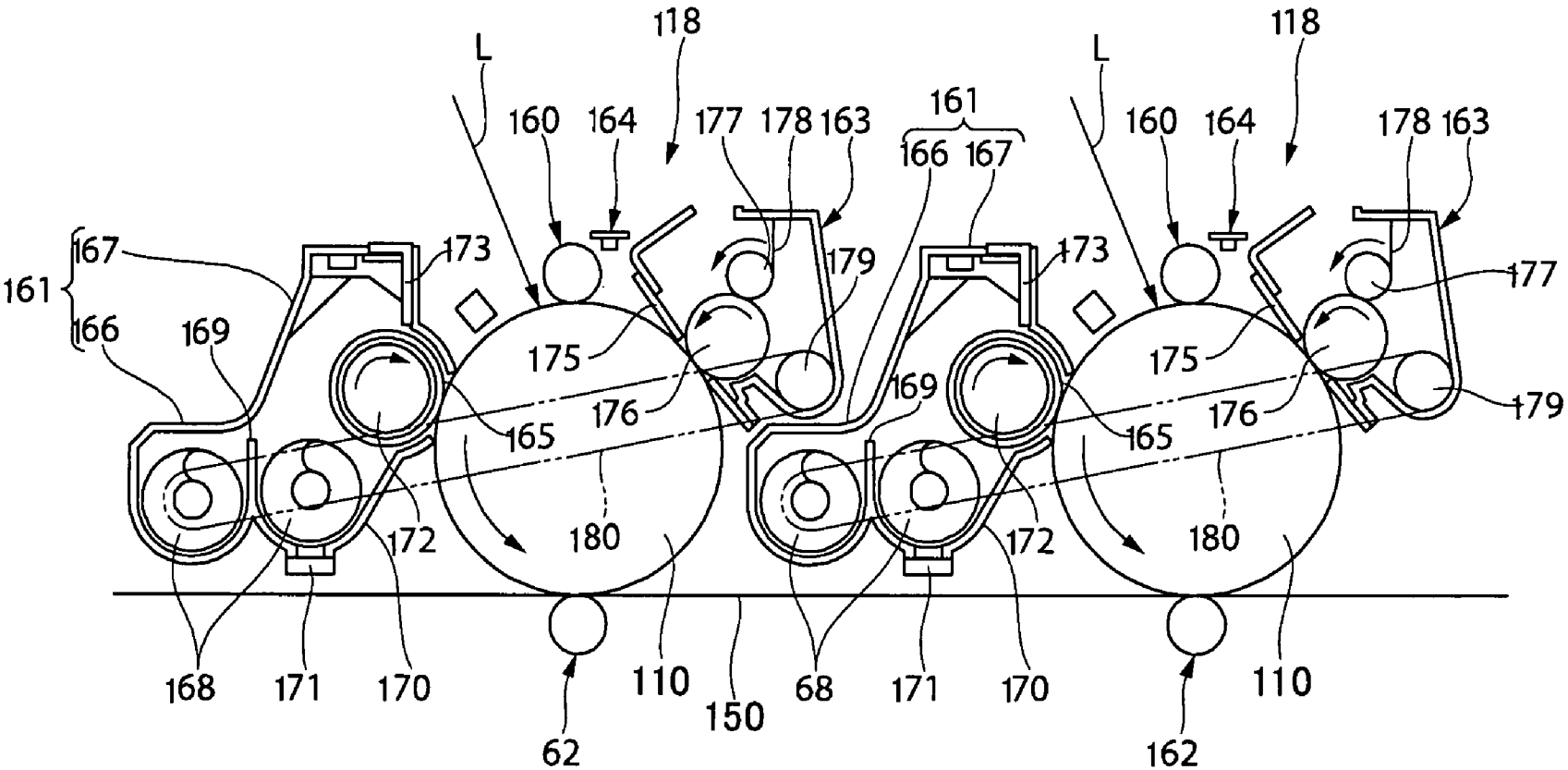
FIG. 11 is a partly enlarged schematic view of the image forming apparatus shown in FIG. 10.

Each of the black, yellow, magenta, and cyan image information is transmitted to each of the image forming units 118 for black, yellow, magenta, and cyan image forming in the tandem image forming apparatus to thereby form black, yellow, magenta, and cyan toner image therein. Specifically, each of the image forming units 18 in the tandem image forming apparatus comprises, as shown FIG. 11, photoconductor 110 (black photoconductor 110K, yellow photoconductor 110Y, magenta photoconductor 110M, and cyan photoconductor 110C), charger 160 for charging the photoconductor 110 uniformly; exposer for exposing the photoconductor 110 each color imagewise based on each color image information, which is indicated by L in FIG. 11, to form latent electrostatic images corresponding to each individual color image on the photoconductor 110; image developing unit 161 configured to develop the latent electrostatic images using respective color toners of black toner, yellow toner, magenta toner, and cyan toner to form toner images corresponding to each color toner; transferring charger 162 for transferring the latent electrostatic images onto intermediate transfer member 150; photoconductor cleaner 163; and charge-eliminator 164 and can form monochrome images in black, yellow, magenta, and cyan image based on each of the color image information. The black image formed on the photoconductor for black 110K, the yellow image formed on the photoconductor for yellow 110Y, the magenta image formed on the photoconductor for magenta 110M, and the cyan image formed on the photoconductor for cyan 110C are sequentially transferred onto intermediate transfer member 150 which is rotated and shifted by the support rollers 114, 115, and 116. Then, the black image, the yellow image, magenta image, and the cyan image are superimposed to thereby form a composite color image i.e. transferred color image.

One of feeder rollers 142 in the feeder table 200 is selectively rotated, sheets or recording papers are ejected from one of multiple feeder cassettes 144 in paper bank 143, are separated by separation roller 145 one by one into feeder path 146, are transported by a transport roller 147 into feeder path 148 in the copier main body 250 and are bumped against resist roller 149. Alternatively, feeder roller 142 is rotated to eject sheets or recording papers on manual bypass tray 151, the sheets are separated one by one by separation roller 152 into manual bypass feeder path 153 and are bumped against the resist roller 149. The resist roller 149 is typically grounded, however, it may be used under application of a bias to remove paper dust of the sheets.

The resist roller 149 is rotated in synchronization with the movement of the composite color image i.e. transferred color image on the intermediate transfer member 150 to transport the sheet (recording paper) into between the intermediate transfer member 150 and the secondary image transferer 122, and the composite color image is transferred onto the sheet by action of the secondary image transferer 122 (secondary transferring) to thereby transfer and form the color image onto the sheet. Separately, the intermediate transfer member cleaner 117 removes a residual toner on the intermediate transfer member 150 after image transfer.

Process Cartridge

A process cartridge of the present invention comprises a latent electrostatic image bearing member, a metal-containing compound adhesion unit configured to make a metal-containing compound adhere on the surface of the latent electrostatic image bearing member, and at least one selected from a charger, a developing unit, a transferring unit, and cleaning unit, in which the rate of variability in the content of metallic atoms in a metal-containing compound adhered on the surface of the latent electrostatic image bearing member which is represented by the following Equation 1 is 10% to 70%.

$$\text{Rate of variability}=(W2/W1)\times 100 \qquad \text{Equation 1}$$

When the rate of variability is less than 10%, abrasion of blade edge may increase, and when the rate of variability is more than 70%, smear may occur on the charge roller.

$$\text{Rate of variability}=(W2/W1)\times 100 \qquad \text{Equation 1}$$

However, in Equation 1, W1 represents the content (atomic %) of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content (atomic %) of metallic atoms in the metal-containing compound adhered on the surface of the latent electrostatic image bearing member according to x-ray photoelectron spectroscopy (XPS) after 100 sheets of paper are continuously printed through the use of an image forming apparatus.

The metal-containing compound is a metallic salt having coordination number 2 being straight chain fatty acids, and the content of metallic atoms in the metallic salt having coordination number 2 being straight chain fatty acids adhered on the surface of the latent electrostatic image bearing member after 100 sheets of paper are continuously printed through the use of an image forming apparatus is preferably 0.3 atomic % to 2.0 atomic %, and more preferably 0.6 atomic % to 1.2 atomic %.

The developing unit comprises a developer container to house the toner and the developer; and a developer carrier configured to carry and transport the toner and the developer housed in the developer container and may further comprise a layer thickness controlling member or the like for controlling the thickness of the toner layer to be carried thereon.

The process cartridge of the present invention is preferably capable of being detachably mounted on various types of image forming apparatuses, and it is particularly preferable that the process cartridge is detachably mounted on an image forming apparatus of the present invention.

Figure 12:
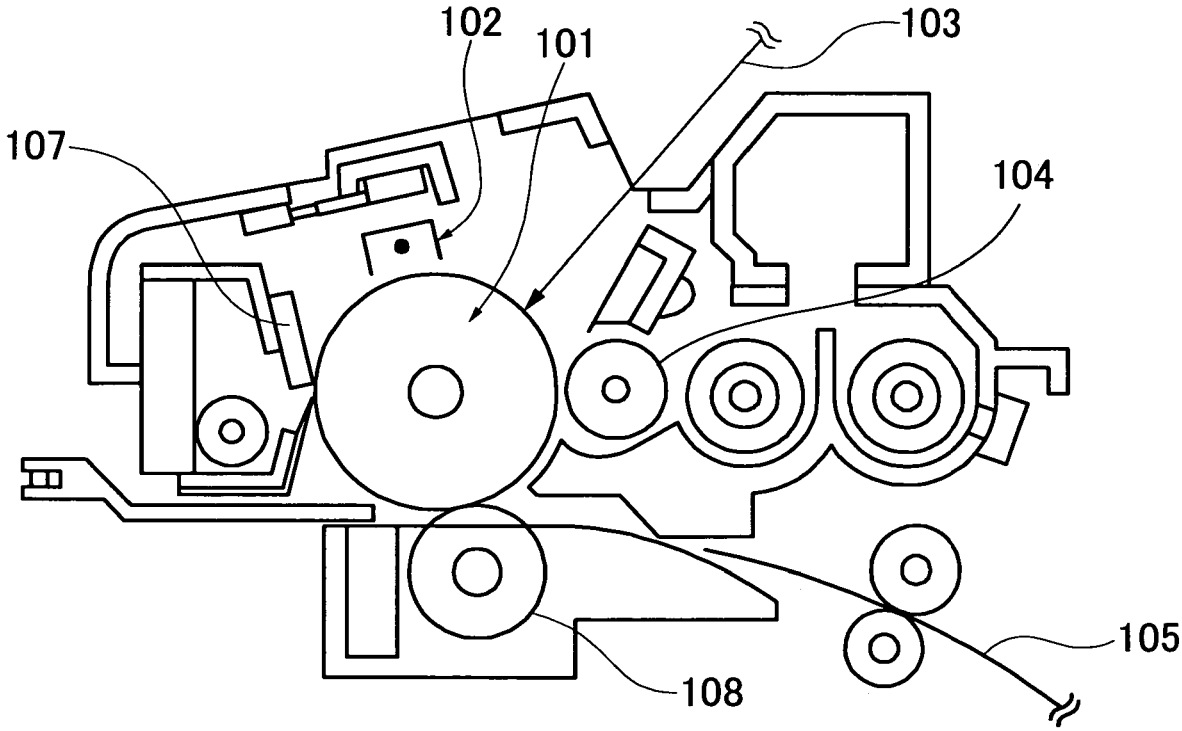
FIG. 12 is a schematic view showing an example of the process cartridge of the present invention.

Here, as shown in FIG. 12, the process cartridge incorporates photoconductor 101 and comprises charging unit 102, developing unit 104, and cleaning unit 107, and further comprises other members in accordance with the necessity. In FIG. 12, the reference number 103, 105, and 108 represent an exposing unit, a recording medium, and a transport roller, respectively.

For the photoconductor, the above noted ones can be used.

Fort the charging unit 102, arbitrarily selected charge members is used.

The image forming apparatus of the present invention may comprise constituent elements such as an image developing apparatus and a cleaner as a process cartridge integrally in a single body, and this unit may be detachably mounted to the main body of the image forming apparatus. Further, the image forming apparatus may comprises a latent electrostatic image bearing member sustained together with at least one selected from a charger, an exposer, a developer, a transferer or a separator, and a cleaner integrally to constitute a process cartridge which is formed in an integral unit to detachably mounted to the main body of the image forming apparatus using a guiding unit such as a rail laid in the main body.

<Toner>

The toner is not particularly limited, provided that the toner has a volume average particle diameter of 7 μm or less and an average circularity of 0.97 or more, and may be selected in accordance with the intended use. For example, an active hydrogen group-containing compound is reacted with a polymer capable of reacting with the active hydrogen group-containing compound in an aqueous medium to produce and obtain an adhesive base in particulate, which may be referred to as toner binder. The adhesive base comprise color materials such as pigments and further comprises other components such as releasing agents, resin fine particles, unreactive polyester resins, and charge controlling agents.

Adhesive Base Material

The adhesive base exhibits adhesiveness to recording media such as papers, comprises a polymer which is produced by reacting the active hydrogen group-containing compound and a polymer capable of reacting with the active hydrogen group-containing compound in an aqueous medium, and may further comprise other binders suitably selected from binder resins known in the art.

The mass average molecular mass of the adhesive base is not particularly limited, may be suitably selected in accordance with the intended use, and for example, it is preferably 1,000 or more, more preferably 2,000 to 10,000,000, and still more preferably 3,000 to 1,000,000.

When the mass average molecular mass is less than 1,000, anti-hot offset may degrade.

The grass transition temperature (Tg) of the adhesive base is not particularly limited, may be suitably selected in accordance with the intended use, and for example, it is preferably 30° C. to 70° C., and more preferably 40° C. to 65° C.

When the glass transition temperature (Tg) is less than 30° C., heat resistant storage properties of the toner may degrade, and when it is more than 70° C., low-temperature fixing property may be insufficient.

The adhesive base is not particularly limited, may be suitably selected in accordance with the intended use, and specifically, polyester resins are particularly preferable.

The polyester resins are not particularly limited, may be suitably selected in accordance with the intended use, and for example, urea-modified polyester resins or the like are particularly preferable.

The urea-modified polyester resin can be produced by reacting amines (B) used as the active hydrogen group-containing compound with isocyanate group-containing polyester prepolymer (A) used as a polymer that can be reacted with the active hydrogen-containing compound in the aqueous medium.

The urea-modified polyester resin may comprise urethane bonds besides urea bonds. In this case, the content molar ratio of the urea bonds and the urethane bonds, urea bonds/urethane bonds, is not particularly limited, may be suitably selected in accordance with the intended use, however, it is preferably 100/0 to 10/90, more preferably 80/20 to 20/80, and still more preferably 60/40 to 30/70.

When the content of the urea bonds is less than 10, anti-hot offset property may degrade.

Specifically, examples of the urea-modified polyester resin are preferably the following (1) to (10):

(1) A mixture of (i) polycondensation product of bisphenol A ethyleneoxide dimolar adduct and isophthalic acid, and (ii) urea-modified polyester prepolymer which is obtained by reacting isophorone diisocyanate with a polycondensation product of bisphenol A ethyleneoxide dimolar adduct and isophthalic acid so as to form polyester prepolymer, and modifying the polyester prepolymer with isophorone diamine:

(2) A mixture of (iii) a polycondensation product of bisphenol A ethyleneoxide dimolar adduct and terephthalic acid, and (ii) urea-modified polyester prepolymer which is obtained by reacting isophorone diisocyanate with a polycondensation product of bisphenol A ethyleneoxide dimolar adduct and terephthalic acid so as to form polyester prepolymer, and modifying the polyester prepolymer with isophorone diamine;

(3) A mixture of (iv) polycondensation product of a bisphenol A ethyleneoxide dimolar adduct, a bisphenol A propyleneoxide dimolar adduct and terephthalic acid, and (v) urea-modified polyester prepolymer which is obtained by reacting isophorone diisocyanate with a polycondensation product of a bisphenol A ethyleneoxide dimolar adduct, a bisphenol A propyleneoxide dimolar adduct and terephthalic acid so as to form polyester prepolymer, and modifying the polyester prepolymer with isophorone diamine;

(4) A mixture of (vi) polycondensation product of a bisphenol A propyleneoxide dimolar adduct and terephthalic acid, and (v) urea-modified polyester prepolymer which is obtained by reacting isophorone diisocyanate with a polycondensation product of a bisphenol A ethyleneoxide dimolar adduct, a bisphenol A propyleneoxide dimolar adduct and terephthalic acid so as to form polyester prepolymer, and modifying the polyester prepolymer with isophorone diamine;

(5) A mixture of (iii) polycondensation product of a bisphenol A ethyleneoxide dimolar adduct and terephthalic acid, and (vi) urea-modified polyester prepolymer which is obtained by reacting isophorone diisocyanate with a polycondensation product of a bisphenol A ehtyleneoxide dimolar adduct and terephthalic acid so as to form polyester prepolymer, and modifying the polyester prepolymer with hexamethylene diamine;

(6) A mixture of (iv) polycondensation product of a bisphenol A ethylneoxide dimolar adduct, a bisphenol A propyleneoxide dimolar adduct and terephthalic acid, and (vi) urea-modified polyester prepolymer which is obtained by reacting isophorone diisocyanate with a polycondensation product of a bisphenol A ethyleneoxide dimolar adduct and terephthalic acid so as to form polyester prepolymer, and modifying the polyester prepolymer with hexamethylene diamine;

(7) A mixture of (iii) polycondensation product of a bisphenol A ethyleneoxide dimolar adduct and terephthalic acid, and (vii) urea-modified polyester prepolymer which is obtained by reacting isophorone diisocyanate with a polycondensation product of a bisphenol A ethyleneoxide dimolar adduct and terephthalic acid so as to form polyester prepolymer, and modifying the polyester prepolymer with ethylene diamine;

(8) A mixture of (i) polycondensation product of a bisphenol A ethyleneoxide dimolar adduct and isophthalic acid, and (viii) urea-modified polyester prepolymer which is obtained by reacting diphenylmethane diisocyanate with a polycondensation product of a bisphenol A ethyleneoxide dimolar adduct and isophthalic acid so as to form polyester prepolymer, and modifying the polyester prepolymer with hexamethylene diamine:

(9) A mixture of (iv) polycondensation product of a bisphenol A ethyleneoxide dimolar adduct, a bisphenol A propyleneoxide dimolar adduct and terephthalic acid, and (ix) urea-modified polyester prepolymer with is obtained by reacting diphenylmethane diisocyanate with a polycondensation product of a bisphenol A ethyleneoxide dimolar adduct and dodecenylsuccinc anhydride so as to form polyester prepolymer, and modifying the polyester prepolymer with hexamethane diamine;

(10) A mixture of (i) polycondensation product of a bisphenol A ethyleneoxide dimolar adduct and isophthalic acid, and (x) urea-modified polyester prepolymer which is obtained by reacting toluene diisocyanate with a polycondensation product of a bisphenol A ehtyleneoxide dimolar adduct and isophthalic acid so as to form polyester prepolymer, and modifying the polyester prepolymer with hexamethane diamine.

Active Hydrogen Group-Containing Compound

The active hydrogen group-containing compound functions as an elongation initiator or crosslinking agent at the time of elongation reactions or crosslinking reactions of the active hydrogen group-containing compound and the polymer capable of reacting with the compound in an aqueous medium.

The active hydrogen group-containing compound is not particularly limited, provided that it contains an active hydrogen group, and may be suitably selected in accordance with the intended use. When the polymer capable of reacting with the active hydrogen group-containing compound is (A) a polyester prepolymer containing an isocyanate group, the active hydrogen group-containing compound is preferably selected from (B) amines from the perspective of capability of high molecular mass polymerization resulted from elongation reaction, crosslinking reaction, and the like.

Within the active hydrogen group-containing compound, the active hydrogen group is not particularly limited and may be suitably selected in accordance with the intended use. Examples of the active hydrogen group include hydroxyl groups such as an alcoholic hydroxyl group, and a phenolic hydroxyl group; amino groups; carboxyl groups; and mercapto groups, each of which may be used alone or in combination with two or more. Of these, alcoholic hydroxyl groups are particularly preferable.

The amines (B) are not particularly limited, may be suitably selected in accordance with the intended use, and examples thereof include diamines (B1), trivalent or more polyamines (B2), aminoalcohols (B3), aminomercaptans (B4), amino acids (B5), and compounds (B6) in which any of the amino groups B1 to B5 is blocked.

Each of these amines may be used alone or in combination with two or more. Among these amines, diamines (B1) and mixtures of diamines (B1) with a small amount of trivalent or more polyamines (B2) are particularly preferable.

Examples of the diamine (B1) include aromatic diamines, alicyclic diamines, and aliphatic diamines. Examples of the aromatic diamines include phenylene diamine, diethyl toluene diamine, and 4,4'-diamino diphenyl methane. Examples of the alicyclic diamines include 4,4'-diamino-3,3'-dimethyl dicyclohexyl methane, diamine cyclohexane, and isophorone diamine. Examples of the aliphatic diamines include ethylene diamine, tetramethylene diamine, and hexamethylene diamine.

Examples of the trivalent or more polyamines (B2) include diethylene triamine, and triethylene tetramine.

Examples of the aminoalcohols (B3) include ethanol amine, and hydroxyethylaniline.

Examples of the amino mercaptans (B4) include aminoethyl mercaptan, and aminopropyl mercaptan.

Examples of the amino acids (B5) include aminopropionic acids, aminocaproic acids.

Examples of the compounds (B6) in which the amino groups B1 to B5 are blocked include ketimine compounds which are obtained from any of the above-noted amines B1 to B5 and ketones such as acetones, methyl ethyl ketones, and methyl isobutyl ketones, and oxazolidone compounds.

To stop elongation reactions and cross-linking reactions between the active hydrogen group-containing compound and a polymer capable of reacting with the active hydrogen group-containing compound, a reaction stopper can be used. When the reaction stopper is used, it is preferable in terms of controlling the molecular mass of the adhesive bases in a desired range. Examples of the reaction stopper include monoamines such as diethylamines, dibutylamines, butylamines, and lauryl amines or compounds in which any of these monoamines are blocked or ketimine compounds.

For the mixture ratio of the amines (B) to the isocyanate group-containing polyester prepolymer (A), the mixture equivalent ratio [NCO]/[NHx] of the isocyanate group [NCO] in the isocyanate group containing polyester prepolymer (A) to the amino group [NHx] in the amines (B) is preferably 1/3 to 3/1, more preferably 1/2 to 2/1, and still more preferably 1/1.5 to 1.5/1.

When the mixture equivalent ratio [NCO]/[NHx] is less than 1/3, low-temperature fixing property may degrade, and when it is more than 3/1, the molecular mass of the urea-modified polyester resin lowers, which may cause degraded anti-hot offset property.

Active Hydrogen-Containing Compound and Polymer Reactive Thereto

The polymer capable of reacting with the active hydrogen-containing compound, which may be hereinafter referred to as prepolymer, is nor particularly limited, provided that it comprises a region capable of reacting with the active hydrogen-containing compound, may be suitably selected from resins known in the art. Examples thereof include polyol resins, polyacryl resins, polyester resins, epoxy resins, and resins of derivatives thereof.

Each of these polymers may be used alone or in combination with tow or more. Among these polymers, polyester resin are particularly preferable in terms of high flowability and transparency when melted.

The resin capable of reacting with the active hydrogen-containing compound in the prepolymer is not particularly limited, may be suitably selected from substituent groups known in the art, and examples thereof include isocyanate groups, epoxy groups, carboxylic acids, and acid chloride groups.

Each of groups may be included alone or in combination with two or more. Among the groups, isocyanate groups are particularly preferable.

Among the above prepolymers, the prepolymer is preferably a polyester resin containing a group capable of generating urea bonding (RMPE) from the perspective of controllability of the molecular mass of high molecular component, oil-less and low-temperature fixing properties of a dry toner, especially from the perspective of assuring suitable releasing and fixing properties without a releasing oil applicator for a heating member for fixing.

Examples of the group capable of generating urea bonding include isocyanate group. When the group capable of generating urea bonding in the polyester resin (RMPE) is the isocyanate group, the polyester resin (RMPE) is particularly preferably (A) a polyester prepolymer having an isocyanate group.

The isocyanate group-containing polyester prepolymer (A) is not particularly limited, may be suitably selected in accordance with the intended use, and examples thereof include polycondensation products of polyols (PO) and polycarboxylic acids (PC), and the products obtained by reacting the active hydrogen-containing polyester resin with polyisocyanate (PIC).

The polyols (PO) are not particularly limited, may be suitably selected in accordance with the intended use, and examples thereof include diols (DIO), trivalent or more polyols (TO), and mixtures of diols (DIO) and trivalent or more polyols (TO). Each of these may be used alone or in combination with two or more. Among them, the diols (DIO) alone or mixture of the diols (DIO) and a small amount of trivalent or more polyols (TO) are preferable.

Examples of the diol (DIO) include alkylene glycols, alkylene ether glycols, alicyclic diols, alkylene oxide adducts of the alicyclic diols, bisphenols, and alkylene oxide adduct of the bisphenols.

The alkylene glycols preferably have carbon atoms, and examples thereof include ethylene glycol, 1,2-propylene glycol, 1,3-propylene glycol, 1,4-butandiol, and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexane dimethanol, and hydrogenated bisphenol A. Examples of the alkylene oxide adducts of the alicyclic diols include compounds in which alkylene oxides such as ethylene oxides, propylene oxides, butylene oxides are added to the alicyclic diols. Examples of the bisphenols include bispheonol A, bisphenol F. and bisphenol S. Examples of the alkylene oxide adducts of the alicyclic diols include compounds in which alkylene oxides such as ethylene oxides, propylene oxides, and butylene oxides are added to the bisphenols. Among the above mentioned, alkylene glycols having 2 to 12 carbon atoms and alkylene oxide adducts of bisphenols are preferable, and alkylene oxide adducts of bisphenols and mixtures of the alkylene oxide adducts of bisphenols with alkylene glycols having 2 to 12 carbon atoms are particularly preferable.

For the trivalent or more polyols (TO), trivalent to octavalent or more polyols are preferable, and examples thereof include trivalent or more polyaliphatic alcohols, trivalent or more polyphenols, and alkylene oxide adducts of trivalent or more polyphenols.

Examples of the trivalent or more polyaliphatic alcohols include glycerine, trimethylol ethane, trimethylol propane, pentaerythritol, and sorbitol. Examples of the trivalent or more polyphenols include trisphenol PA, phenol novolac, and cresol novolac. Examples of the alkylene oxide adducts of the trivalent or more polyphenols include compounds in which alkylene oxides such as ethylene oxides, propylene oxides, and butylene oxides are added to the trivalent or more polyphenols.

The mixture equivalent ratio of the diols (DIO) and the trivalent or more polyols (TO) in the mixture of the diols (DIO) and the trivalent or more polyols (TO) is preferably 100:0.01 to 100:10, and more preferably 100:0.01 to 100:1.

The polycarboxylic acid (PC) is not particularly limited, may be suitably selected in accordance with the intended use, and examples thereof include dicarboxylic acids (DIC), trivalent or more polycarboxylic acids (TC), and mixture of dicarboxylic acids (DIC) and trivalent or more polycarboxylic acids.

These polycarboxylic acids may be used alone or in combination with two or more. Among them, dicarboxylic acid (DIC) alone or mixtures of dicarboxylic acid (DIC) and a small amount of trivalent or more polycarboxylic acids (TC) are preferable.

Examples of the dicarboxylic acids include alkylene dicarboxylic acids, alkenylen dicarboxylic acids, and aromatic dicarboxylic acids. Examples of alkylene dicarboxylic acids include succinic acids, adipic acids, and sebacic acids. Examples of the alkenylen dicarboxylic acids include maleic acids, and fumaric acids. Examples of the aromatic dicarboxylic acids include phthalic acids, isophthalic acids, terephthalic acids, and naphthalene dicarboxylic acids.

Among them, alkenylen dicarboxylic acids having 4 to 20 carbon atoms and aromatic dicarboxylic acids having 8 to 20 carbon atoms are preferable.

Examples of the trivalent or more polycarboxylic acids (TO) are trivalent to octavalent or more polycarboxylic acids, and examples thereof include aromatic polycarboxylic acids.

The aromatic polycarboxylic acids preferably have 9 to 20 carbon atoms, and examples thereof include trimellitic acids, and pyromellitic acids.

For the polycarboxylic acids (PC), any of acid anhydrides selected from the dicarboxylic acids (DIC), the trivalent or more polycarboxylic acids (TC), and mixtures of the dicarboxylic acids (DIC) with the trivalent or more polycarboxylic acids or lower alkyl esters can also be used. Examples of the lower alkyl esters include methyl esters, ethyl esters, and isopropyl esters.

The mixture mass ratio DIC:TC of the dicarboxylic acids (DIC) to the trivalent or more polycarboxylic acids (TC) in the mixture of the dicarboxylic acids (DIC) and the trivalent or more polycarboxylic acids (TC) is not particularly limited, may be suitably selected in accordance with the intended use, and for example, the mixture mass ratio is preferably 100:0.01 to 100:10, and more preferably 100:0.01 to 100:1.

The mixture ratio of polycondensation reaction between the polyols (PO) and the polycarboxylic acids (PC) is not particularly limited, may be suitably selected in accordance with the intended use, however, for example, the equivalent ratio [OH]/[COOH] of hydroxy group [OH] content in the polyols (PO) and carboxyl group [COOH] content in the polycarboxylic acids (PC) is preferably 2/1 to 1/1, more preferably 1.5/1 to 1/1, and still more preferably 1.3/1 to 1.02/1.

The polyol (PO) content to the isocyanate group-containing polyester prepolymer (A) is not particularly limited, may be suitably selected in accordance with the intended use, and for example, the content is preferably 0.5% by mass to 40% by mass, more preferably 1% by mass to 30% by mass, and still more preferably 2% by mass to 20% by mass.

When the content is less than 0.5% by mass, anti-hot offset property degrades, and it may be difficult to effectively bring out both heat resistant storage property and low-temperature fixing property. When the content is more than 40% by mass, low-temperature fixing property may degrade.

The polyisocyanates (PIC) are not particularly limited, may be suitably selected in accordance with the intended use. Examples of the polyisocyanates include aliphatic polyisocyanates, alicyclic polyisocyanates, aromatic diisocyanates, aromatic aliphatic diisocyanates, isocyanurates, phenol derivatives thereof, and polyisocyanates blocked with oximes, caprolactams or the like.

Examples of the aliphatic polyisocyanates include tetramethylen diisocyanate, hexamethylene diisocyanate, and 2,6-diisocyanato methyl caproate, octomethylene diisocyanate, decamethylene diisocyanate, dodecamethylene diisocyanate, tetradecamethylene diisocyanate, trimethyl hexane diisocyanate, and tetramethyl hexane diisocyanate. Examples of the alicyclic polyisocyanates include isophorone diisocyanate, and cyclohexyl methane diisocyanate. Examples of the aromatic diisocyanates include tolylene diisocyanate, and diphenylmethane diisocyanate, 1,5-naphthylene diisocyanate, diphenylene-4,4'-diisocyanate, 4,4'-diisocyanato-3,3'-dimethyldiphenyl, 3-methyl diphenyl methane-4,4'-diisocyanate, diphenylether-4,4'-diisocyanate. Examples of the aromatic aliphatic diisocyanates include $\alpha$, $\alpha$, $\alpha'$, $\alpha'$-tetramethyl xylylene diisocyanate. Examples of the isocyanurates include tris-isocyanatoalkyl-isocyanurate, tri-isocyanatocycloalkyl-isocyanurate.

Each of these polyisocyanates may be used alone or in combination with two or more.

For the mixture ratio when reacting the polyisocyanates (PIC) and the active hydrogen group-containing polyester resins for example, hydroxy group-containing polyester resins, the mixture equivalent ratio [NCO]/[OH] of isocyanate group [NCO] content in the polyisocyanate (PIC) and hydroxy group [OH] content in the hydroxy group-containing polyester resin is preferably 5/1 to 1/1, more preferably 4/1 to 1.2/1, and still more preferably 3/1 to 1.5/1.

When the content of the isocyanate group [NCO] is more than 5, low-temperature fixing property may degrade, and when the content is less than 1, anti-offset property may degrade.

The content of the polyisocyanate (PIC) in the isocyanate group-containing polyester prepolymer (A) is not particularly limited and may be suitably selected in accordance with the intended use, for example, it is preferably 0.5% by mass to 40% by mass, more preferably 1% by mass to 30% by mass, and still more preferably 2% by mass to 20% by mass.

When the content of the polyisocyanate is less than 0.5% by mass, anti-hot offset property degrades, and it may be difficult to effectively bring out both heat resistant storage property and low-temperature fixing property. When the content is more than 40% by mass, low-temperature fixing property may degrade.

The average number of isocyanate groups contained per molecule of the isocyanate group-containing polyester prepolymer (A) is preferably 1 or more, more preferably 1.2 to 5, and still more preferably 1.5 to 4.

When the average number of the isocyanate group is less than 1, the molecular mass of the polyester resin (RMPE) modified by the urea bond formation group lowers, and anti-hot offset property may degrade.

Aqueous Medium

The aqueous medium is not particularly limited, may be suitably selected in accordance with the intended use, and examples thereof include water, water-miscible solvents, and mixtures thereof.

The water-miscible solvents are not particularly limited, provided that the solvent is miscible with water, and examples thereof include alcohols, dimethylformamide, tetrahydrofuran, Cellosolves, and lower ketones.

Examples of the alcohols include methanols, isopropanols, and ethylene glycols. Examples of the Cellosolves include methyl Cellosolve. Examples of the lower ketones include acetone, and methyl ethyl ketone.

Each of these may be used alone or in combination with two or more.

Other Components

Other components mentioned above are not particularly limited, may be suitably selected in accordance with the intended use, and examples thereof include cleaning ability improvers, flowability imparting agents, releasing agents, colorants, unreactive polyester resins, charge controlling agents, and magnetic materials. These components can be externally added to the toner in dry process.

The cleaning ability improvers are added to the toner for the purpose of removing a residual toner remaining on a photoconductor and a primary transferring medium after transferring, and examples thereof include metallic salts of fatty acids such as zinc stearates, calcium stearates, and stearic acids; and polymer fine particles produced by means of soap-free emulsion polymerization such as polymethyl methacrylate fine particles, and polystyrene fine particles. The polymer fine particles preferably have a relatively narrow particle size distribution and a volume average particle diameter of 0.01 μm to 1 μm.

Preferred examples of the flowability imparting agents are the same fine particles as described above.

The fine particles are externally added to the toner in wet process, however, it is preferred to externally add the flowability imparting agents in dry process for the purpose of reinforcing effects of external addition of the fine particles.

The colorants are not particularly limited, may be suitably selected in accordance with the intended use, and examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone.

The colorant content to the toner is not particularly limited, may be suitably selected in accordance with the intended use, however, it is preferably 1% by mass to 20% by mass, and more preferably 3% by mass to 15% by mass.

When the content is less than 1% by mass, tinting power may be insufficient, and when the content is more than 20% by mass, fixing property may degrade.

The colorant may be used as a masterbatch compounded with a resin. The resin is not particularly limited and may be suitably selected from those known in the art in accordance with the intended use. Examples of the resin include styrenes or polymers of derivative substitution thereof, styrene copolymers, polymethyl methacrylates, polybutylmethacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic hydrocarbon resins, alicyclic hydrocarbon resins, aromatic petroleum resins, chlorinated paraffins, and paraffin waxes. Each of these may be used alone or in combination with two or more.

Examples of the styrenes or polymers of derivative substitution thereof include polyester resins, polystyrenes, poly-p-chlorostyrenes, polyvinyl toluenes. Examples of the styrene copolymers include styrene-p-chlorostyrene copolymers, styrene-propylene copolymers, styrene-vinyltoluene copolymers, styrene-vinylnahthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-keton copolymers, styrene-butadiene copolymers, styrene-isoprene copolymers, styrene-acrylonitrile-indene copolymers, styrene-maleic acid copolymers, and styrene-ester maleate copolymers.

The masterbatch may be produced by applying a high shearing force to the resins for the masterbatch and the colorants and mixing or kneading the components. Here, to improve the interaction between the colorants and the resins, it is preferred to add an organic solvent thereto. Besides, a so-called flashing process is preferably employed, because in the flashing process, a wet cake of colorants can be directly used without the necessity of drying. In the flashing process, a colorant-water-paste containing water is mixed and kneaded with resins and an organic solvent to transfer the colorants to the resins and then to remove the moisture and the organic solvent components. For the mixing or kneading, a high shearing dispersion unit such as a triple roll mill is preferably used.

The releasing agents are not particularly limited, may be suitably selected in accordance with the intended use, and preferred examples thereof include waxes.

Examples of the waxes include carbonyl group-containing waxes, polyolefin waxes, and long-chain hydrocarbons. Each of these may be used alone or in combination with two or more. Among them, carbonyl group-containing waxes are preferably used.

Examples of the carbonyl group-containing waxes include polyalkanoic acid esters, polyalkanol esters, polyalkanoic amides, polyalkylamides, and dialkylketones. Examples of the polyalkanoic acid esters include carnauba wax, montan wax, trimethylolpropane tribehenate, pentaerythritol tetrabehenate, pentaerythritol diacetate dibehenate, glycerin behenate, and 1,18-octadecandiol distearate. Examples of the polyalkanol esters include tristearyl trimellitate, and distearyl maleate. Examples of the polyalkanoic amides include dibehenylamides. Examples of the polyalkylamides include tristearylamide trimellitate. Examples of the dialkylketones include distearylketone. Among these carbonyl group-containing waxes, polyalkanoic acid esters are particularly preferable.

Examples of the polyolefin waxes include polyethylene waxes, and polypropylene waxes.

Examples of the long-chain hydrocarbons include paraffin waxes, and sazole waxes.

The melting point of the wax used in the present invention is typically 40° C. to 160° C., preferably 50° C. to 120° C., and more preferably 60° C. to 90° C. A wax having a melting point less than 40° C.

When the melting point is less than 40° C., the wax may negatively affect heat resistant storage properties, and when the melting point is more than 160° C., it may easily cause cold offset phenomenon when fixing at low temperatures.

The content of the releasing agent in the toner is not particularly limited and may be suitably selected in accordance with the intended use, however, it is preferably 0% by mass to 40% by mass, and more preferably 3% by mass to 30% by mass.

When the content is more than 40% by mass, flowability of the toner may degrade, and durability of the developer may degrade.

The resin fine particles which are internally added to the toner as OMS are typically used for the purpose of controlling toner shape such as average circularity, and particle size distribution. When the toner binder is produced, and shape of the toner particles is formed, the resin fine particles adhere to and combine with surfaces of the toner particles.

The resin fine particles are preferably formed with a resin capable of forming a water-based dispersion liquid in an aqueous medium and may be formed with a resin which is suitably selected from those known in the art in accordance with the intended use. The resin may be a thermoplastic resin or a thermosetting resin.

Specifically, examples of the resin include vinyl reins, polyurethane resins, epoxy resins, polyester resins, polyamide resins, polyimide resins, silicon resins, phenol resins, melamine resins, urea resins, aniline resins, ionomer resins, and polycarbonate resins.

Each of these resins may be used alone or in combination with tow or more. Among them, vinyl resins, polyurethane resins, epoxy resins, polyester resins, and mixtures thereof are preferable because the water-based dispersion liquid of resin fine particles in a microscopic spherical shape is easily prepared. The vinyl resins are polymers of which vinyl monomer is solely polymerized or copolymerized, and examples thereof include styrene-(meth)acrylate ester resins, styrene-butadiene copolymers, (meth)acrylate-acrylic ester polymers, styrene-acrylonitrile copolymers, styrene-maleic anhydride copolymers, and styrene-(meth)acrylate copolymers.

The glass transition temperature (Tg) of the resin fine particles is not particularly limited, may be suitably selected in accordance with the intended use, and for example, it is preferably 40° C. to 100° C., and more preferably 60° C. to 80° C.

When the glass transition temperature (Tg) is less than 40° C., storage stability of the toner may degrade, and blocking may occur in the developing unit during storage. When the glass transition temperature (Tg) is more than 100° C., the resin fine particles impede adhesiveness with fixing paper, and lower limit of fixing temperature may be increased.

The mass average molecular mass (Mw) of the resin fine particles is not particularly limited, may be suitably selected in accordance with the intended use, and for example, it is preferably 9,000 to 500,000, and more preferably 20,000 to 200,000.

When the mass average molecular mass (Mw) is less than 9,000, storage stability of the toner may degrade, and blocking may occur in the developing unit during storage. When the mass average molecular mass (Mw) is more than 500,000, the resin fine particles impede adhesiveness with fixing paper, and lower limit of fixing temperature may be increased.

The average particle diameter of the resin fine particles is not particularly limited, may be suitably selected in accordance with the intended use, and for example, it is preferably 5 nm to 500 nm, and more preferably 30 nm to 300 nm.

When the average particle diameter is less than 5 nm, particle diameter controlling property may degrade, and when the average particle diameter is more than 500 nm, particle size distribution may be broad.

The content of the resin fine particles in the toner is not particularly limited, may be suitably selected in accordance with the intended use, and for example, it is preferably 0.5% by mass to 5.0% by mass, and more preferably 1.0% by mass to 3.0% by mass.

The content of the resin fine particles in the toner can be measured by various methods, for example, it can be calculated by analyzing substances and/or functional groups and the like which are attributable only to the resin fine particles using a pyrolysis gas chromatographic spectrometer and using the peak area of the substances and/or functional groups and the like.

The unreactive polyester resin may be included in the toner for the purpose of improving low-temperature fixing property, and gloss property.

The unreactive polyester resin is not particularly limited, may be suitably selected from those known in the art in accordance with the intended use, and examples thereof include the same resins as in the urea-bond formation group-containing polyester resin, namely, polycondensation compounds of polyols (PO) and polycarboxylic acids (PC). The unreactive polyester resins may be not only unmodified polyesters but also polyesters which are modified with chemical bonds other than urea bonds, for example, they may be modified with urethane bonds. It is preferred that part of the unreactive polyester resin be compatible with the urea bond formation group-containing polyester resin (RMPE), namely, it is preferred to have a similar structure which is able to be compatible each other, from the perspective of low-temperature fixing property and anti-hot offset property.

The mass average molecular mass of the unreactive polyester resin is not particularly limited and may be suitably selected in accordance with the intended use. For example, it is preferably 1,000 to 30,000, and more preferably 1,500 to 15,000 according to the value measured by means of Gel Permeation Chromatography (GPC).

When the mass average molecular mass is less than 1,000, offset property may degrade, and when it is more than 30,000, low-temperature fixing property may degrade.

The acid value of the unreactive polyester resin is preferably 1 to 50, and more preferably 5 to 30. Typically, by giving acid values to the toner, it is negatively charged with ease.

When the unreactive polyester resin is included in the toner, the mixture mass ratio RMPE/PE of the urea bond formation group-containing polyester resin (RMPE) and the unreactive polyester resin (PE) is preferably 5/95 to 80/20, more preferably 5/95 to 30/70, and still more preferably 5/95 to 25/75.

When the mixture mass ratio of the unreactive polyester resin (PE) is more than 95, anti-hot offset property may degrade, and when it is less than 20, low-temperature fixing property may degrade.

The charge controlling agent is not particularly limited and may be suitably selected from those known in the art in accordance with the intended use, however, the charge controlling agent is preferably formed by a material having a color close to transparent and/or white because original color tone may be changed when a colored material is used therein. Examples of the charge controlling agent include nigrosine dyes, triphenylmethane dyes, chrome-containing metallic complex dyes, molybdic acid chelate pigments, rhodamine dyes, alkoxy amines, quaternary ammonium salts such as fluoride-modified quaternary ammonium salt, alkylamides, phosphoric simple substance or compounds thereof, tungsten simple substance or compounds thereof, fluoride activator, salicylic acid metallic salts, salicylic acid derivative metallic salts. Each of these may be used alone or in combination with two or more.

The charge controlling agent for use in the present invention is also selected from the commercially available products under the trade names of, for example, Bontron 03 of a nigrosine dye, Bontron P-51 of a quaternary ammonium salt, Bontron S-34 of a metal-containing azo dyes, Bontron E-82 of an oxynaphthoic acid metal complex, Bontron E-84 of a salicylic acid metal complex, and Bontron E-89 of a phenol condensate (manufactured by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.); copper phthalocyanine, perylene, quinacridone, azo pigments, and other high-molecular mass compounds having a functional group such as sulfonic acid group, carboxyl group, and quaternary ammonium salt.

The charge controlling agent may be dissolved and dispersed in the toner material after kneading with the masterbatch. The charge controlling agent may also be added at the time of dissolving and dispersing in the organic solvent together with the toner material. In addition, the charge controlling agent may be added and fixed onto the surface of the toner particles after producing the toner particles.

The amount of the charge controlling agent used in the toner is determined depending on the type of a binder resin, presence or absence of an additive, and the method for dispersion process in the course of producing the toner and is not limited uniformly, however, preferably, relative to 100 parts by mass of the toner binder, 0.1 parts by mass to 10 parts by mass of the charge controlling agent is used and more preferably with 0.2 parts by mass to 5 parts by mass of the charge controlling agent. When the usage amount is less than 0.1 parts by mass, charge properties may be insufficient. When the usage amount of the charge controlling agent is more than 10 parts by mass, charge properties of the toner is exceedingly large, which may lessen flowability of the developer and reduce image density.

The magnetic material is not particularly limited and may be suitably selected from those known in the art in accordance with the intended use. Preferred examples thereof are iron powder, magnetite, and ferrite. Among these, one having a white color is preferable in terms of tone.

The toner is not particularly limited as to shape, size, and the like, may be suitably determined in accordance with the intended use, however, the toner is preferred to have the following average circularity, volume average particle diameter, ratio of volume average particle diameter to number average particle diameter, shape factor SF-1, heat properties, and the like.

The average circularity is a value which a circumference equivalent to a circle having the same projected area to the toner particle shape is divided by a circumference of the actual toner particle. The average circularity is preferably, for example, 0.97 or more, and more preferably 0.97 to 0.99.

When the average circularity is less than 0.97, it is rarely capable of obtaining a desirable transferability, and high quality images without dust. When the average circularity is more than 0.99, it is liable to cause image smear resulted from cleaning failure to a photoconductor and a transfer belt in an image-forming system utilizing a cleaning blade. Specifically, in the case of a formation of images having large image area such as photographic images, a toner forming an image remains on a photoconductor due to paper feed failure or the like, and becomes a residual toner. Such a residual toner is accumulated on the photoconductor and the accumulated residual toner causes background smear on the formed image, or pollutes a charge roller which contact-charges the photoconductor, and the charge roller may not exhibit original chargeability.

The average circularity can be measured, for example, by an optical detection zone method in which a suspension containing the toner is passed through an image-detection zone disposed on a plate, the particle images of the toner are optically detected by means of a CCD camera, and the obtained particle images are analyzed. For example, Flow-type particle image analyzer FPIA-2100 (manufactured by Sysmex Corp.) is employed for such method.

The volume average particle diameter of the toner is preferably, for example, 7 μm or less, and more preferably 3 μm to 7 μm.

When the volume average particle diameter is 3 μm or less, when a two-component developer is used, toner is fused on the surface of carrier in long-hours agitation in a developing apparatus, which may cause degradation of chargeability of carrier, and when a one-component developer is used, toner filming to a developing roller and toner fusion to members such as a blade for making toner have a thin layer are liable to occur. On the other hand, when the volume average particle diameter is more than 7 μm, it is difficult to obtain high quality of image with high resolution.

For the ratio of volume average particle diameter to number average particle diameter, volume average particle diameter/number average particle diameter, for example, it is preferably 1.25 or less, and more preferably 1.10 to 1.25.

When the ratio of volume average particle diameter/number average particle diameter is more than 1.25, it is difficult to obtain high quality image with high resolution, and when toner inflow/outflow occurs during developing, particle diameter of the toner may substantially vary. On the other hand, when the ratio is less than 1.10, it may be impossible to sufficiently charge the toner, and it may degrade cleaning ability, although it is preferable in terms of stabilizing toner behavior and uniformizing charged amount.

The volume average particle diameter, and the ratio of volume average particle diameter and number average particle diameter can be measured by using a particle sizer, for example, Coulter Counter TAII manufactured by Coulter Electronics Ltd.

Shape factor SF-1 is defined as a value obtained by the following processes. One hundred toner images of magnified 500 diameters using an electron microscope, for example, FE-SEM (S-800) manufactured by HITACHI Ltd., were sampled randomly. The image information was introduced to an image-analyzer LuzexIII manufactured by NICORE CORPORATION) via an interface and analyzed and calculated using the following equation.

$$SF\text{-}1=[(M\times LNG)^2/\mathrm{AREA}]\times(100\pi/4)$$

In the equation, M×LNG represents the absolute maximum length of a toner particle, and AREA represents the projected area of a toner particle.

The shape factor SF-1 represents the degree of roundness of a toner particle.

Toner particles produced by melting, kneading-crushing method are formed in indefinite shape. Typically, shape factor SF-1 of toner particles exceeds 150, and the shape factor SF-1 of toner is preferably 100 to 135, and more preferably 100 to 120. When the shape factor SF-1 is more than 135, toner shape is far from spherical shape to near indefinite shape, and the thickness of the toner layer and the surface are uneven, and the contact area between toner and transferring sheet and the contact area between toner and latent electrostatic image bearing member are reduced. Therefore, transferring effectiveness may degrade, resulting in increased transferring current, which may cause an increase in discharge when an image is isolated.

The heat properties are referred to as flow-tester property and evaluated as melting point (Ts), flow starting temperature (Tfb), melting point according to ½ method, and the like.

These heat properties can be measured with the methods suitably selected and can be obtained from a flow curve measured using an elevated Flow Tester CFT 500 (manufactured by SHIMADZU Corp.)

The melting temperature (Ts) is not particularly limited and may be suitably selected in accordance with the intended use, for example, it is preferably 50° C. or more, and more preferably 60° C. to 100° C. When the melting point (Ts) is less than 50° C., heat resistant storage stability may degrade.

The flow staring temperature (Tfb) is not particularly limited and may be suitably selected in accordance with the intended use, for example, it is preferably 60° C. or more, and more preferably 70° C. to 150° C. When the flow starting temperature (Tfb) is less than 60° C., offset property may degrade.

The melting point according to ½ method (T½) is not particularly limited and may be suitably selected in accordance with the intended use, for example, it preferably 70° C. or more, and more preferably 90° C. to 170° C. When the melting point according to ½ method (T½) is less than 70° C., offset property may degrade.

Colors of the toner are not particularly limited, may be suitably selected in accordance with the intended use, and it may be at least one selected from black toner, cyan toner, magenta toner, and yellow toner, and each of these color toners can be obtained by suitably selecting the types of the colorants.

According to an image forming method of which the above noted toner is applied to a photoconductor used in the present invention, there is only a small amount of moisture absorbance of toner even under high temperature and high humidity conditions, occurrence of image blur and streaky or patchy image defects such as black void are prevented, and highly durable and high quality images can be obtained. The toner used in the present invention can be suitably used for various fields and more preferably used for forming of images based on electrophotography technique.

The toner can be produced by the methods known in the art, however, it can be suitably produced by the toner production method described below.

<Toner Production Method>

The toner production method comprises producing an adhesive base and further comprises suitably selected other steps in accordance with the necessity.

Production of Adhesive Base

The production of an adhesive base is a step for dispersing the active hydrogen group-containing compound and a polymer capable of reacting with the active hydrogen group-containing compound in the aqueous medium for reaction to thereby produce an adhesive base as well as to obtain a toner.

In the production of the adhesive base, for example, the following steps are carried out. An aqueous medium phase is prepared, an organic solvent phase is prepared, emulsion and dispersion of toner materials are carried out, a polymer i.e. lo prepolymer capable of reacting with the active hydrogen group-containing compound is synthesized, and the active hydrogen group-containing compound is synthesized.

The preparation of an aqueous medium phase is carried out, for example, by dispersing the fine resin particles in the aqueous medium. The amount of the fine resin particles added in the aqueous medium is not particularly limited, and can be appropriately adjusted in accordance with the intended use. For example, the amount is preferably 0.5% by mass to 10% by mass.

The preparation of a organic solvent phase is carried out, for example, by dissolving and dispersing toner materials such as the active hydrogen group-containing compound, the polymer capable of reacting with the active hydrogen group-containing compound, the above-noted pigments, the releasing agents, the charge controlling agents, and the unreactive polyester resin in the organic solvent.

It should be noted that the toner material other than the polymer (prepolymer) capable of reacting with the active hydrogen group-containing compound can be added and mixed in the aqueous medium at the time of dispersing the fine resin particles in the aqueous medium in the preparation of the aqueous medium phase. Alternatively, the polymer is added to the aqueous medium phase together with the organic solvent phase at the time of adding the organic solvent phase to the aqueous medium phase.

The organic solvent is not particularly limited and may be suitably selected in accordance with the intended use, provided that the organic solvent allows dissolution and dispersion of the toner materials. It is preferable that the organic solvent be a volatile organic solvent having a boiling point of less than 150° C. in view of easy removal from the solution or dispersion. Preferred examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone. Among these solvents, ethyl acetate, toluene, xylene, benzene, methylene chloride, 1,2-dichloroethane, chloroform, carbon tetrachloride are particularly preferable. Each of these solvents may be used alone or in combination of two or more.

The usage amount of the organic solvent is not particularly limited, may be suitably selected in accordance with the intended use, and it is preferably 40 parts by mass to 300 parts by mass, more preferably from 60 parts by mass to 140 parts by mass, and still more preferably from 80 parts by mass to 120 parts by mass relative to 100 parts by mass of the toner materials.

The emulsion and dispersion can be carried out by emulsifying and dispersing the previously prepared organic solvent phase in the previously prepared aqueous medium phase. At the time of emulsifying and dispersing, the active hydrogen group-containing compound and the polymer capable of reacting with the active hydrogen group-containing compound are subjected to elongation and/or cross-linking reaction to thereby form the adhesive base.

The adhesive base (e.g. the urea-modified polyester resin) is formed, for example, by the following method (1) to (3):

(1) the organic solvent phase containing the polymer capable of reacting with the active hydrogen group-containing compound (e.g. (A) polyester prepolymer containing an isocyanate group) is emulsified and dispersed in the aqueous medium phase together with the active hydrogen group-containing compound so as to form a dispersion, and then the active hydrogen group-containing compound and the polymer capable of reacting with the active hydrogen group-containing compound are subjected to elongation and/or cross-linking reaction in the aqueous medium phase;

(2) the organic solvent phase is emulsified and dispersed in the aqueous medium previously added with the active hydrogen group-containing compound to form a dispersion, and then the active hydrogen group-containing compound and the polymer capable of reacting with the active hydrogen group-containing compound are subjected to elongation and/or cross-linking reaction in the aqueous medium phase; alternatively, (3) the organic solvent phase is added and mixed in the aqueous medium, the active hydrogen group-containing compound is sequentially added thereto so as to form a dispersion, and then the active hydrogen group-containing compound and the polymer capable of reacting with the active hydrogen group-containing compound are subjected to elongation and/or cross-linking reaction at an interface of dispersed particles in the aqueous medium phase.

In the case of the method (3), it should be noted that the modified polyester is initially formed on surfaces of the obtained toner particles, and thus it is possible to provide a density gradient of the modified polyester on the toner particles.

Conditions for subjecting the active hydrogen group-containing compound and the polymer capable of reacting with the active hydrogen group-containing compound to elongation and/or cross-linking reactions to form the adhesive base are not particularly limited, may be suitably adjusted in accordance with the combination of the polymer capable of reacting with the active hydrogen group-containing compound and the active hydroxy group-containing compound. A suitable reaction time is preferably 10 minutes to 40 hours, and more preferably 2 hours to 24 hours. A suitable reaction temperature is preferably 0° C. to 150° C., and more preferably 40° C. to 98° C.

For a method for stably forming the dispersion containing the active hydrogen group-containing compound and the polymer capable of reacting with the active hydrogen group-containing compound (e.g. the (A) polyester prepolymer containing an isocyanate group) in the aqueous medium phase, it is achieved by, to the aqueous medium phase, adding the polymer capable of reacting with the active hydrogen group-containing compound (e.g. the isocyanate group containing polyester prepolymer (A)) which is dissolved and dispersed in the organic solvent and toner materials such as the polymer (e.g. the (A) polyester prepolymer containing an isocyanate group), the colorant, the wax, the charge controlling agent, the non-modified polyester and the like is dissolved and/or dispersed in the organic solvent, and dispersing by a shear force.

The method of dispersing is not particularly limited and may be suitably selected from the conventional dispersing units for use. Examples of the dispersing units include a low-speed-shear dispersing unit, a high-speed-shear dispersing unit, a friction dispersing unit, a high-pressure-jet dispersing unit, an ultrasonic dispersing unit. Among these, the high-speed-shear dispersing unit is preferable in terms of the capability of controlling particle diameter of the dispersion from 2 μm to 20 μm.

When the high-speed-shear dispersing unit is used, the conditions such as rotation speed, dispersing time, and dispersing temperature are not particularly limited, and may be suitably adjusted in accordance with the intended use. For example, the rotation speed is preferably 1,000 rpm to 30,000 rpm, and more preferably 5,000 rpm to 20,000 rpm. In the case of the batch method, the dispersing time is preferably 0.1 minutes to 5 minutes, and the dispersing temperature is preferably 0° C. to 150° C., and more preferably 40° C. to 98° C. under pressure. Typically, the dispersion is more easily carried out at high dispersing temperatures.

In the cause of emulsification and dispersion, the usage amount of the aqueous medium is preferably 50 parts by mass to 2,000 parts by mass, and more preferably 100 parts by mass to 1,000 parts by mass relative to 100 parts by mass of the toner materials.

When the usage amount of the aqueous medium is less than 50 parts by mass, the toner materials are not suitably dispersed, and thus toner particles having a predetermined particle diameter may not be obtained. When the usage amount of the aqueous medium is more than 2,000 parts by mass, the production cost is liable to increase.

In the emulsification and dispersion process, a dispersant is preferably used in accordance with the necessity in order to sharpen the particle size distribution of the dispersed particles and to stabilize the dispersed particles.

The dispersant is not particularly limited and may be suitably selected in accordance with the intended use, and examples thereof include surfactants, water-insoluble inorganic dispersants, polymeric protective colloids. Each of these dispersants may be used alone or in combination with two or more. Among them, surfactants are preferably used.

Examples of the surfactant include anionic surfactants, cationic surfactants, nonionic surfactants, and ampholytic surfactant.

Examples of the anionic surfactants are alkylbenzene sulfonates, α-olefin sulfonates, phosphate esters. Among these, an anionic surfactant having a fluoroalkyl group is preferable. Examples of the anionic surfactant having a fluoroalkyl group include fluoroalkyl carboxylic acid having 2 to 10 carbon atoms or metallic salts thereof, disodium perfluorooctanesulfonylglutamate, sodium-3-{omega-fluoroalkyl ($C_6$ to $C_{11}$)oxy}-1-alkyl($C_3$ to $C_4$) sulfonate, sodium-3-{omega-fluoroalkanoyl($C_6$ to $C_8$)-N-ethylamino}-1-propanesulfonate, fluoroalkyl($C_{11}$ to $C_{20}$) carboxylic acid or metallic salts thereof, perfluoroalkyl($C_7$ to $C_{13}$) carboxylic acid or metallic salts thereof, perfluoroalkyl($C_4$ to $C_{12}$) sulfonic acid or metallic salts thereof, perfluorooctanesulfonic acid diethanol amide, N-propyl-N-(2-hydroxyethyl) perfluorooctanesulfone amide, perfluoroalkyl($C_6$ to $C_{10}$)sulfoneamide propyltrimethylammonium salts, a salt of perfluoroalkyl ($C_6$ to $C_{10}$)-N-ethylsulfonyl glycine, monoperfluoroalkyl($C_6$ to $C_{16}$)ethylphosphate. Examples of the commercially available surfactants having a fluoroalkyl group are Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactants include surfactants of amine salts, and cationic surfactants of quaternary amine salts. Examples of the surfactants of amine salts are alkyl amine salts, aminoalcohol fatty acid derivatives, polyamine fatty acid derivatives, and imidazolines. Examples of the cationic surfactants of quaternary ammonium salts are alkyltrimethyl ammonium salts, dialkyldimethyl ammonium salts, alkyldimethyl benzyl ammonium salts, pyridinium salts, alkyl isoquinolinium salts, and benzethonium chlorides. Among these cationic surfactants, preferred examples are primary, secondary or tertiary aliphatic amines having a fluoroalkyl group, aliphatic quaternary ammonium salts such as perfluoroalkyl ($C_6$ to $C_{10}$)sulfoneamide propyltrimethylammonium salt, benzalkonium salt, benzetonium chloride, pyridinium salt, and imidazolinium salt. Specific examples of the commercially available products thereof are Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

Examples of the nonionic surfactants include fatty acid amide derivatives, and polyhydric alcohol derivatives.

Examples of the ampholytic surfactants include alanine, dodecyldi(aminoethyl)glycin, di(octylaminoethyle)glycine, and N-alkyl-N,N-dimethylammonium betaine.

Examples of the water-insoluble inorganic dispersants include tricalcium phosphates, calcium carbonates, titanium oxides, colloidal silicas, and hydroxyl apatites.

Examples of the polymeric protective colloids include acids, (meth)acryl monomers having a hydroxyl group, vinyl alcohols or esters with vinyl alcohols, esters of vinyl alcohol and a compound having a carboxyl group, amide compounds or methylol compounds thereof, chlorides, monopolymers or copolymers having a nitrogen atom or heterocyclic ring thereof, polyoxyethylenes, and celluloses.

Examples of the acids include acrylic acids, methacrylic acids, α-cyanoacrylic acids, α-cyanomethacrylic acids, itaconic acids, crotonic acids, fumaric acids, maleic acids, and maleic anhydrides.

Examples of the (meth)acryl monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl acrylate, 3-chloro -2-hydroxypropyl acrylate, 3-chloro -2-hydroxypropyl methacrylate, diethyleneglycol monoacrylate, diethyleneglycol monomethacrylate, glycerin monoacrylate, glycerin monomethacrylate, N-methylol acrylamido, and N-methylol methacrylamide.

Examples of vinyl alcohols or esters with vinyl alcohols include vinyl methyl ethers, vinyl ethyl ethers, and vinyl propyl ethers.

Examples of esters of vinyl alcohol and a compound having a carboxyl group include vinyl acetates, vinyl propionates, and vinyl butyrates.

Examples of the amide compounds or methylol compounds thereof include acryl amides, methacryl amidse, diacetone acrylic amide acids, or methylols thereof.

Examples of the chlorides include acrylic chlorides, and methacrylic chloride.

Examples of the monopolymers or copolymers having a nitrogen atom or heterocyclic ring thereof include vinyl pyridines, vinyl pyrrolidone, vinyl imidazole, and ethylene imine.

Examples of the polyoxyethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, and polyoxyethylene nonylphenyl ester.

Examples of the celluloses include methyl cellulose, hydroxyethyl cellulose, and hydroxypropyl cellulose.

In the emulsification and dispersion process, a dispersion stabilizer is used in accordance with the necessity. Examples of the dispersion stabilizer include acids such as calcium phosphate, and alkali-soluble compounds.

When the dispersion stabilizer is used, calcium phosphate is dissolved by acids such as hydrochloric acid and then washed with water or decomposed by an enzyme to thereby remove calcium phosphate from fine particles.

The obtained toner particles as above are subjected to mixing with particles such as the releasing agents and the charge controlling agents and further to application to mechanical impact to thereby prevent the particles such as the releasing agents falling off from the surface of the toner particles.

Examples of the method of applying mechanical impact include a method in which an impact is applied by rotating a blade at high speed, and a method in which an impact is applied by introducing the mixed particles into a high-speed flow and accelerating the speed of the flow so as to make the particles impact with each other or so as to make the composite particles impact upon an impact board. Examples of a device employed in such method are an angmill (manufactured by Hosokawamicron Corp.), a modified I-type mill (manufactured by Nippon Pneumatic Manufacturing. Co., Ltd.) to decrease crushing air pressure, a hybridization system (manufactured by Nara Machinery Co., Ltd.), a krypton system (manufactured by Kawasaki Heavy Industries, Ltd.), and an automatic mortar.

Hereinafter, preferred examples of the toner production method will be described.

Production of Adhesive Base

Preparation of Aqueous Medium Phase (Aqueous Phase)

To a reaction vessel equipped with a stirrer and a thermometer, water, sodium salt of sulfuric ester of ethylene methacrylate oxide adducts, styrene, methacrylic acid, and ammonium persulfate were implanted and stirred at 400 rpm for 15 minutes and then a white emulsion can be obtained. The emulsion was heated to raise the temperature of the system to 75° C., and the reaction was performed for 5 hours, 1% by mass of ammonium persulfate solution was further added to the reaction liquid and matured at 75° C. for 5 hours to prepare an aqueous dispersion liquid of a copolymer of styrene-methacrylic acid-sodium salt of sulfuric ester of ethylene methacrylate oxide adducts (hereinafter, briefly referred to as particulate emulsion). Then, water, the particulate emulsion, and an aqueous solution of 48.5% by mass of sodium dodecyl diphenyl ether disulfonate, and ethyl acetate were mixed and stirred to prepare a milky-white liquid (hereinafter, briefly referred to as aqueous phase).

Synthesis of Prepolymer (Polyester Capable of Reacting with the Active Hydrogen Group-Containing Compound)

To a reaction vessel equipped with a condenser tube, a stirrer, and nitrogen inlet tube, bisphenol A ethylene oxide dimolar adduct, bisphenol A propylene oxide trimolar adduct, terephthalic acid, adipic acid, and dibutyltin oxide were poured, and the reaction was performed at 230° C. under normal pressure for 8 hours, and the reaction of the reaction liquid was further performed under a reduced pressure of 10 mmHg to 15 mmHg for 5 hours, then trimellitic anhydride was poured into the reaction vessel, and the reaction was performed at 180° C. under normal pressure for 2 hours to synthesize a low-molecular-mass polyester.

Thereafter, to a reaction vessel equipped with a condenser, a stirrer, and a nitrogen inlet tube, the low-molecular-mass polymer, isophorone diisocyanate, and ethyl acetate were poured, and the reaction was performed at 100° C. for 5 hours to thereby synthesize a prepolymer (the polymer capable of reacting with the active hydrogen group-containing compound).

Synthesis of Ketimine (The Active Hydrogen Group-Containing Compound)

To a reaction vessel equipped with a stirrer and a thermometer, isophorone diamine and methyl ethyl ketone were implanted, and the reaction was performed at 50° C. for 5 hours to synthesize a ketimine compound (the active hydrogen group-containing compound).

Preparation of Organic Solvent Phase

To a reaction vessel equipped with a stirrer and a thermometer, the low-molecular-mass polyester, a synthesized ester wax (pentaerythritol tetrabehenate), and ethyl acetate were implanted, and the temperature was raised to 80° C. with stirring, maintained at 80° C. for 5 hours, and cooled to 30° C. in 1 hour. Next, ethyl acetate was implanted to the reaction vessel and mixed for 1 hour to obtain an initial material solution.

To a reaction vessel, the initial material solution was transferred, and wax was dispersed using a bead mill (Ultra Visco Mill, manufactured by AIMEX CO., LTD.) under the conditions of liquid feed rate 1 kg/hr, disk circumferential speed of 6 m/sec, 0.5 mm zirconia beads filled to 80% by volume, and three passes. Next, 65% by mass of ethyl acetate solution of the low-molecular-mass polyester was added to the dispersion liquid and then dispersed once (1 pass) under the same conditions as described above to thereby prepare an organic solvent phase.

Emulsion and Dispersion

The organic solvent phase, the prepolymer (low-molecular-mass polyester), and the ketimine compound were poured into a reaction vessel, and them mixed at 5,000 rpm for 1 minute using a TK homomixer (TOKUSHU KIKA KOGYO., LTD.), and the aqueous phase was added to the reaction vessel and mixed at 13,000 rpm for 20 minutes using a TK homomixer to be emulsified and dispersed therein to thereby prepare an emulsion slurry. Next, to a reaction vessel equipped with a stirrer and a thermometer, the emulsion slurry was poured, the solvent was removed at 30° C. for 8 hours, and the emulsion slurry was further left at rest at 50° C. for 6 hours.

The emulsion slurry left at rest was filtered under reduced pressure, and then ion exchange water was added to the filter cake and mixed in a TK homomixer at 12,000 rpm for 10 minutes, and the filter cake was further filtered. To the filter case obtained herein, a 10% by mass sodium hydroxide aqueous solution was added and mixed at 12,000 rpm for 30 minutes using a TK homomixer while giving ultrasonic vibration thereto and then filtered under reduced pressure. Then the alkali washing using ultrasonic vibration was performed again. To the filter cake obtained herein, 10% by mass of hydrochloride was added and mixed at 12,000 rpm for 10 minutes and then filtered. To the filter cake obtained herein, ion exchange water was added, mixed at 12,000 rpm for 10 minutes using a TK homomixer and then filtered, and the handling of addition of the ion exchange water to the filtering was performed twice to thereby obtain a filter case. The filter cake obtained herein was dried in the circulating air dryer at 45° C. for 48 hours, and then sieved through a sieve of 75 μm mesh to thereby obtain toner particles.

By mixing the obtained toner particles with hydrophobic silica and hydrophobized titanium oxide using HENSCHEL MIXER, it is possible to produce the toner.

<Developer>

A developer used in the present invention contains at least the toner and further contains suitably selected other components such as carrier. The developer may be a one-component developer or a two-component developer, however, when used for high-speed printers or the like responding to improvements in high-speed information processing in recent years, the two-component developer is preferably used from the perspective of improvements in operating life of the high-speed printers.

When the one-component developer with the toner included therein is used, it is less varied in particle diameter of the toner even when toner inflow/outflow is performed, filming of toner to developing rollers, and fusion of toner to members such as blade for making toner have a thin layer rarely occur, and excellent and stable developing properties and images can be obtained even in long-hour usage (agitation) in a developing apparatus. When the two-component developer with the toner included therein is used, it is less varied in particle diameter of the toner even when toner inflow/outflow is performed, and excellent and stable developing properties can be obtained even under long-hour agitation in a developing apparatus.

The carrier is not particularly limited, may be suitably selected in accordance with the intended use, however, it is preferred to have a core material and a resin layer coating the core material.

Materials used for the core material are not particularly limited, may be suitably selected from those in the art, and examples thereof include 50 emu/g to 90 emu/g of manganese-strontium (Mn—Sr) materials and manganese-magnesium materials are preferable. From the perspective of assuring image density, ferromagnetic materials such as iron powder (100 emu/g or more), and magnetite (70 emu/g to 120 emu/g) are preferable. From the perspective of ability of weakening the touch to a photoconductor on which toner is standing and advantages in making high-quality images, feeble magnetic materials such as copper-zinc (Cu—Zn) materials (30 emu/g to 80 emu/g) are preferable. Each of these materials may be used alone or in combination with two or more.

The average particle diameter (volume average particle diameter ($D_{50}$)) of the core material is preferably 20 μm to 200 μm, and more preferably 40 μm to 100 μm.

When the average particle diameter (volume average particle diameter ($D_{50}$)) is less than 20 μm, the amount of fine particles increases in carrier particle distribution, the magnetization intensity per particle may lower to cause carrier scattering. When the average particle diameter (volume average particle diameter ($D_{50}$)) is more than 200 μm, specific surface area is reduced, which may cause toner scattering, and in a full-color image with lots of solid portions, reproductivity may degrade particularly in the solid portions.

Materials used for the resin layer are not particularly limited and may be suitably selected from resins in the art in accordance with the intended use. Examples thereof include amino resins, polyvinyl resins, polystyrene resins, halogenated olefin resins, polyester resins, polycarbonate resins, polyethylene resins, polyvinyl fluorides, polyvinylidene fluoride resins, polytrifluoro-ethylene resins, polyhexafluoro-propylene resins, copolymers of vinylidene fluoride and acryl monomer, copolymers of vinylidene fluoride and vinyl fluoride, and fluoroterpolymers such as terpolymers of tetrafluoroethylene, vinylidene fluoride, and non-fluoride monomer, and silicone resins. Each of these resins may be used alone or in combination with two or more.

Examples of the amino resins include urea-formaldehyde resins, melamine resins, benzoguanamine resins, urea resins, polyamide resins, and epoxy resins. Examples of the polyvinyl resins include acrylic resins, polymethyl methacrylate resins, polyacrylonitrile resins, polyvinyl acetate resins, polyvinyl alcohol resins, and polyvinyl butyral resins. Examples of the polystyrene resins include polystyrene resins, and styrene-acryl copolymer resins. Examples of the halogenated olefin resins include polyvinyl chlorides. Examples of the polyester resins include polyethylene terephthalate resins, and polybutylene terephthalate resins.

To the resin layer, a conductive powder or the like may be included in accordance with the necessity, and examples of the conductive powder include metal powders, carbon black, titanium oxides, tin oxides, and zinc oxides. The average particle diameter of these conductive powders is preferably 1 μm or less. When the average particle diameter is more than 1 μm, it may be difficult to control electric resistivity.

The resin layer can be formed, for example, by dissolving the silicone resin or the like in a solvent to prepare a coating solution, then uniformly coating the coating solution to the surface of the core material by means of a conventional coating method and drying the surface and then baking the surface. Examples of the coating method include dipping, spraying, and brush coating.

The solvent is not particularly limited, may be suitably used in accordance with the intended use, and examples thereof include toluene, xylene, methyl ethyl ketone, methyl isobutyl ketone, Cellosol-butylacetate. The baking is not particularly limited and may be performed with an external heating process or an internal heating process, for example, there are methods through the use of a fixed electric furnace, a flux electric furnace, a rotary electric furnace, a burner furnace, and a microwave.

The amount of the resin layer used in the carrier is preferably 0.01% by mass to 5.0% by mass.

When the amount of the resin layer is less than 0.01% by mass, the resin layer may not be uniformly formed on the surface of the core material. On the other hand, when the amount is more than 5.0% by mass, the resin layer is so thick that it causes granulations among carrier particles, and uniformly formed carrier particles may not be obtained.

When the developer is the two-component developer, the content of the carrier in the two-component developer is not particularly limited, may be suitably selected in accordance with the intended use, for example, it is preferably 90% by mass to 99% by mass, and more preferably 93% by mass to 97% by mass.

The developer comprises the toner, therefore, when an image is formed using the developer, high-definition and high-quality images can be obtained while keeping the state in excellent blade-cleaning ability, and the like.

The developer can be suitably used for image forming according to various electrophotography known in the art such as a one-component magnetic developing method, a one-component nonmagnetic developing method, and a two-component developing method, and the developer can be suitably used for the process cartridge and the above-mentioned image forming apparatus of the present invention, and the image forming method using the same.

According to the present invention, it is possible to provide a process cartridge, and image forming apparatus, and an image forming method by which it is possible to solve various conventional problems, occurrence of smear of a charge roller in an image forming apparatus equipped with a metal-containing compound adhesion unit on the surface of a latent electrostatic image bearing member as well as to reduce abrasion of blade edge, and to form excellent images in stable condition.

Hereafter, the present invention will be described in detail referring to specific examples, however, the present invention is not limited to the disclosed examples.

PRODUCTION EXAMPLE 1

Production of Latent Electrostatic Image Bearing Member (Photoconductor) A 15 parts by mass of alkyd resin (Becklight M6401-50, manufactured by DAINIPPON INK AND CHEMICALS, INC.) and 10 parts by mass of a melamine resin (SUPER BECKAMINE G-821-60, manufactured by DAINIPPON INK AND CHEMICALS, INC.) were dissolved in 150 parts by mass of methyl ethyl ketone. To the obtained solution, 90 parts by mass of a titanium oxide powder (Tipaque CR-EL, manufactured by Ishihara Sangyo Kaisha) were added and dispersed in a ball mill for 12 hours to prepare an undercoat layer coating solution.

The obtained undercoat layer coating solution was coated on a cylindrical aluminum base having a diameter of 30 mm and a length of 340 mm by dip coating method and then dried at 130° C. for 20 minutes to form an undercoat layer having a thickness of 3.5 μm.

Next, 4 parts by mass of a polyvinyl butyral resin (XYHL, manufactured by UCC Co.) were dissolved in 150 parts by mass of cyclohexanone. To this solution, 10 parts by mass of a bis-azo pigment represented by the following Structural Formula (A) were added and dispersed in a ball mill for 48 hours, and further 210 parts by mass of cyclohexanone were added and dispersed for 3 hours. This dispersion liquid was taken out to a vessel and diluted with cyclohexanone so that the solid content thereof was 1.5% by mass to prepare a coating solution for the charge generating layer.

The obtained coating solution for the charge generating layer was coated on the undercoat layer and dried at 130° C. for 20 minutes to form a charge generating layer having a thickness of 0.2 μm.

Structural Formula (A)

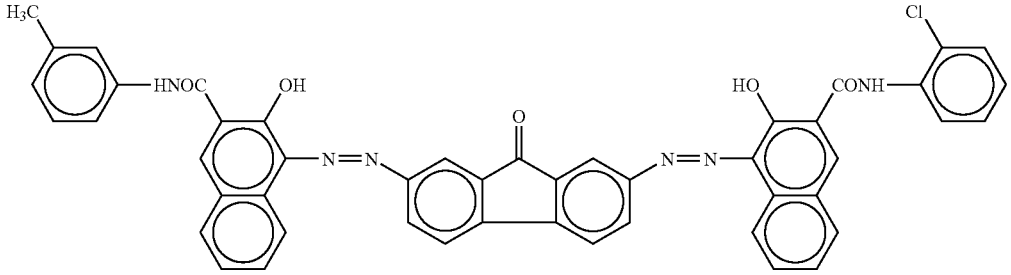

Next, to 100 parts by mass of tetrahydrofuran, 10 parts by mass of bisphenol Z-type polycarbonate resin and 0.002 parts by mass of silicone oil (KF-50, manufactured by Shinetsu Chemical Co., Ltd.) were dissolved. To this solution, 10 parts by mass of charge transporting substance represented by the following Structural Formula (B) were added to prepare a charge transporting layer coating solution. The obtained charge transporting layer coating solution was coated on the charge generating layer by dip coating method and dried at 110° C. for 20 minutes to form a charge transporting layer having a thickness of 25 μm.

Structural Formula (B)

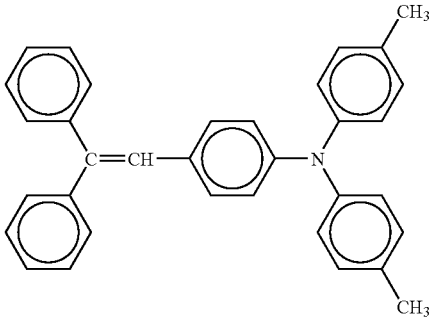

Next, to a mixed medium of 280 parts by mass of tetrahydrofuran and 80 parts by mass of cyclohexanone, 4 parts by mass of bisphenol Z-type polycarbonate resin were dissolved. To the obtained solution, 3 parts by mass of a charge transporting substance represented by Structural Formula (B) and a preliminarily prepared dispersion liquid in which 1 part by mass of α-alumina has been dispersed to 19 parts by mass of cyclohexanone were added to prepare a protective layer-forming coating solution.

The obtained protective layer-forming coating solution was spray coated upon the charge transporting layer using a spray gun (PC308, manufactured by Olympos Co., Ltd.) at an air pressure of 2 kgf/cm$^2$ and oversprayed three times and then died at 130° C. for 20 minutes to form a protective layer having a thickness of 5 μm. Through the above-mentioned processes, a latent electrostatic image bearing member (photoconductor) A was prepared.

PRODUCTION EXAMPLE 2

Production of Latent Electrostatic Image Bearing Member (Photoconductor)

An undercoat layer having a thickness of 3.5 μm and a charge generating layer having a thickness of 0.2 μm were formed on a cylindrical aluminum base having a diameter of 30 mm and a length of 340 mm in the same manner as Production Example 1.

Next, to 80 parts by mass of tetrahydrofuran, 10 parts by mass of polyarylate resin and 0.002 parts by mass of silicone oil (KF-50, manufactured by Shinetsu Chemical Co., Ltd.) were dissolved. To this solution, 10 parts by mass of a charge transporting substance represented by Structural Formula (B) were added to prepare a charge transporting layer coating solution.

The obtained charge transporting layer coating solution was coated on the charge generating layer by dip coating method and then dried at 110° C. for 20 minutes to prepare a charge transporting layer having a thickness of 30 μm. Through the above-mentioned processes, a latent electrostatic image bearing member (photoconductor) B was prepared.

PRODUCTION EXAMPLE 3

Production of Developer A

<Production of Toner>

The toner initial material having the following composition was mixed using HENSCHEL mixer and then dissolved and kneaded using a biaxial kneader which was set at 110° C. The obtained kneaded matter was cooled with water and then coarsely crushed using a cutter mill, pulverized using a pulverizer using jet stream, and classified to thereby prepare toner base particles.

Composition of Toner Initial Material

Binder Resin 100 parts by mass of a polyester resin synthesized with terephthalic acid, fumaric acid, polyoxypropylene-(2,2)-2, 2-bis(4-hyroxyphenyl) propane, and trimellitic acid, serving as a binder resin, having a glass transition temperature (Tg): 62° C. and a melting point 106° C.

Colorants

- Pigment for Yellow toner (disazo yellow pigment: C.I. Pigment Yellow 17) . . . 7.0 parts by mass
- Pigment for Magenta toner (quinacridone magenta pigment: C.I. Pigment Red 122) . . . 7.0 parts by mass
- Pigment for Cyan toner (copper phthalocyanine blue pigment: C.I. Pigment Blue 15:3) . . . 3.5 parts by mass
- Pigment for Black (carbon black: C.I. Pigment Black 7) . . . 6.0 parts by mass
- Zinc salt of salicylic acid derivative serving as a charge controlling agent . . . 2.5 parts by mass
- Carnauba wax serving as a releasing agent (melting point: 85° C.) . . . 5 parts by mass Next, to 100 parts by mass of the obtained toner base particles, 0.8 parts by mass of silica (hexamethyldisilasane surface treatement agent, the average primary particle diameter: 0.01 μm) and 1.0 part by mass of titania (isobutyltrimethoxysilane surface treatment agent, the average primary particle diameter: 0.015 μm) were added and mixed using HENSCHEL mixer and then sieved through a sieve of 100 μm mesh by wind sieving to thereby prepare a toner.

The obtained toner had a volume average particle diameter of 6.81 μm.

Here, the particle size distribution of the toner was measured using Coulter Multi-sizer. Namely, Coulter Multi-sizer IIe (manufactured by Beckmann Coulter Inc.) was used as a measurement device and connected to an interface (manufactured by The Institute of Japanese Union of Scientists & Engineers) and a personal computer for outputting particle number distribution and particle volume distribution. A primary sodium chloride was used as an electrolyte to prepare 1% by mass of NaCl aqueous solution.

For the measurement method, in 100 ml to 150 ml of the electrolyte aqueous solution, a surfactant, preferably 0.1 ml to 5 ml of alkylbenzene sulphonate was added as a dispersant, and 2 mg to 20 mg of measurement sample was added thereto and dispersed for approx. 1 minute to 3 minutes using an ultrasonic disperser. Further, in another beaker, 100 ml to 200 ml of electrolyte was poured, and the sample dispersion liquid was added thereto so as to be a predetermined concentration. The measurement of the sample dispersion liquid was performed by measuring the average of the 50,000 particles using the Coulter Multi-sizer IIe with an aperture of 100 μm.

<Production of Carrier>

450 parts by mass of toluene, 450 parts by mass of silicone resin (SR2400, manufactured by Dow Corning Toray Co., Ltd., nonvolatile portion 50%), 10 parts by mass of aminosilane (SH6020, manufactured by Dow Corning Toray Silicone Co., Ltd.) and 10 parts by mass of carbon black were dispersed with a stirrer for 10 minutes to prepare a coating solution. The obtained coating solution and 5,000 parts by mass of Cu—Zn ferrite particles as a core material (mass average particle diameter: 35 μm) were poured into a coating device equipped with a rotatable bottom plate and stirring fans within a flowing bottom for performing coating while forming swirling flow to coat the coating solution on the core material and calcined at 250° C. for 2 hours using an electric furnace. Through the above-mentioned processes, carrier having a thickness of 0.5 μm was prepared.

Next, to 5 parts by mass of the toner, 95 parts by mass of the carrier were added and mixed in a tabular mixer to prepare a developer A.

PRODUCTION EXAMPLE 4

Production of Developer B

<Synthesis of Toner Binder>

To a reaction vessel equipped with a condenser, a stirrer, and a nitrogen inlet tube, 724 parts by mass of bisphenol A ethylene oxide dimolar adduct, 276 parts by mass of isophthalic acid, and 2 parts by mass of dibutyltin oxide were poured. The reaction was performed at 230° C. under normal pressure for 8 hours, and the reaction was further performed under a reduced pressure of 10 mmHg to 15 mmHg for 5 hours, and then cooled down to 160° C. To the reactant solution, 32 parts by mass of phthalic acid anhydride were added and reacted for 2 hours. Next, the reactant solution was cooled down to 80° C., and the reaction was performed with 188 parts by mass of isophorone diisocyanate in ethyl acetate for 2 hours to synthesize isocyanate-containing prepolymer (1).

Next, 267 parts by mass of the prepolymer (1) were reacted to 14 parts by mass of isophorone diisocyanate at 50° C. for 2 hours to obtain urea-modified polyester (1) having a mass average molecular mass of 64,000.

In the same manner as above mentioned, 724 parts by mass of bisphenol A ethylene oxide dimolar adduct and 276 parts by mass of terephthalic acid were polycondensed at 230° C. for 8 hours under normal pressure, and the reaction was performed under a reduced pressure of 10 mmHg to 15 mmHg for 5 hours to synthesize unmodified polyester (a) having a peak molecular mass of 5,000.

Next, 750 parts by mass of the urea-modified polyester (1) and 250 parts by mass of the unmodified polyester (a) were dissolved in 2,000 parts by mass of a mixed solution of methyl acetate and methyl ethyl ketone (MEK) at a mixture ratio of 1:1 and mixed to obtain an ethyl acetate and methyl ethyl ketone (MEK) solution of toner binder (1). A part of the ethyl acetate and methyl ethyl ketone solution was dried under reduced pressure to isolate toner binder (1). The glass transition temperature (Tg) of the obtained toner binder (1) was 62° C., and the acid value was 10.

<Preparation of Toner>

To a beaker, 240 parts by mass of the ethyl acetate and methyl ethyl ketone (MEK) of toner binder (1), 20 parts by mass of pentaerythritol tetrabehenate (melting point: 81° C., melting viscosity: 25 cps), and 10 parts by mass of carbon black were poured and stirred at a temperature of 60° C. using a TK homomixer at 12,000 rpm to evenly dissolve and disperse them. In the beaker, 706 parts by mass of ion exchange water, 294 parts by mass of a 10% by mass hydroxy apatite suspension (Supatite 10, manufactured by Nippon Chemical Industrial Co., Ltd.), and 0.2 parts by mass of sodium dedecylbenzene sulfonate were poured and dissolved evenly. Then, the dispersion liquid was raised in temperature to 60° C., the toner material solution was poured with stirring the dispersion liquid at 12,000 rpm and stirred for 10 minutes. Next, the mixed solution was transferred to a Kolben equipped with a stirrer and a thermometer, raised in temperature to 98° C. to remove a part of solvent, got it back to room temperature and then further removed the solvent completely. Thereafter, the mixed solution was filtered, washed, and dried and then classified by wind force to thereby obtain toner base particle.

Next, to 100 parts by mass of the toner base particle, 0.5 parts by mass of hydrophobic silica were added and mixed using HENSCEL MIXER to prepare a toner.

The obtained toner had a shape factor SF-1 of 105, an average circularity of 0.99, a dispersion degree of 1.20, and an aggregation rate of 18%.

Next, in the same manner as the developer A, a carrier was produced and a developer was produced to thereby prepare developer B.

PRODUCTION EXAMPLE 5

Production of Intermediate Transfer Member

To 100 parts by mass of polyimide varnish (polyimide varnish for heat resistant film using N-methylpyrrolidone as a solvent, U Varnish-S, manufactured by Ube Kosan K.K.), 18 parts by mass of carbon black were added and sufficiently mixed using a mixer. The obtained undiluted film solution was poured into a cylindrical metal mold made from stainless-steel having a diameter of 168 mm and a height of 500 mm and formed with centrifugal molding technique while drying it with hot air of 120° C. for 120 minutes. Next, the cylindrical film which was removed from the metal mold in a semi-hardened condition was coated on an iron core and raised in temperature from 120° C. to 350° C. in 30 minutes to evaporate the solution and then further heated at 450° C. for 20 minutes and substantially hardened it to make polyamido acid dehydrated and condensed.

The obtained carbon black-dispersed polyimide film having a thickness of 80 μm was cut at a width of 320 mm to form a seamless belt base material having a surface resistivity of $10^{12}$ Ω/square. Next, on the belt base material, a FEP rubber paint (DAI-EL LATEX GLS-213, manufactured by Daikin Industries, Ltd.) was coated by spray coating and then heated at 270° C. for 20 minutes for form a coat layer having a thickness of 50 μm. This coat layer comprises a fluorocarbon rubber layer in which FEP having a thickness of 2 μm as a fluorine resin layer is formed on the surface thereof. Through the above-mentioned processes, an intermediate transfer belt was prepared.

PRODUCTION EXAMPLE 6

Production of Charging Member

To 100 parts by mass of chloroprene rubber, 5 parts by mass of conductive carbon were melted and kneaded and formed such that an axis made from stainless having a diameter of 8 mm and a length of 260 mm was passed through at the core thereof to thereby have a diameter of 20 mm and a length of 240 mm to thereby form a conductive and elastic layer of a charging member formed in a roller shape.

The volume resistivity of the conductive and elastic layer of the charging member measured under the conditions of a temperature of 22° C. and a humidity of RH60% was $3\times10^4$ Ω·cm.

Next, a polyether amide-imide resin was evenly dissolved in tetrahydrofuran so as to have solid portion of 50% by mass and dip-coated on the conductive and elastic layer of the charging member and dried to form a resin layer having a thickness of 200 μm. Through the above-mentioned processes, a charge roller member was produced.

EXAMPLES 1 TO 25 AND COMPARATIVE EXAMPLES 1 TO 12

The thus produced developers A and B, latent electrostatic image bearing members (photoconductors) A and B, image transfer member, and charge roller member were respectively used in combinations shown in Table 1 to thereby set up image forming apparatuses shown in FIG. 7 (indicated by 1 in Table 1) and in FIG. 10 (indicated by 2 in Table 1, tandem-type image forming apparatus) respectively.

In these image forming apparatuses, a metal-containing compound adhesion unit shown in FIG. 1 was disposed behind and at the downstream side of the cleaning unit of the latent electrostatic image bearing member. By using metal-containing compounds shown in Table 1, rotation speeds of brush roller shown in Table 1 and adjusting the load of brush roller shown in Table 1 to these individual metal-containing compounds, images were formed. Various properties of the images were evaluated as described below. Table 2 shows the results.

<Measurement of Metallic Atom Content in Metal-Containing Compound>

A photoelectron spectrometer (1600S-type, manufactured by Philips Electronics N.V.) was used as the evaluation system. The x-ray source was MgKα (100W), and the analyzed region was 0.8 mm×2.0 mm, and the surface atomic concentration of the metal-containing compounds was calculated through the use of relative sensitivity factor supplied by Philips Electronics N.V. The concentration of metallic atoms was calculated as follows. As a ratio of atomic concentration of the elements excluding hydrogen and helium, the content of metallic atoms in the metal-containing compound was obtained, and then the concentration of metallic atoms was calculated with the rate of variability in the content of metallic atoms in the metal-containing compound adhered on the surface of the latent electrostatic image bearing member which is represented by the following Equation 1.

$$\text{Rate of variability}=(W2/W1)\times100 \qquad \text{Equation 1}$$

However, in Equation 1, W1 represents the content (atomic %) of metallic atoms in the metal-containing compound according to x-ray photoelectron spectroscopy (XPS) immediately after the metal-containing compound adhered to the surface of the latent electrostatic image bearing member by the action of the metal-containing compound adhesion unit. W2 represents the content (atomic %) of metallic atoms in the metal-containing compound adhered on the surface of the latent electrostatic image bearing member according to x-ray photoelectron spectroscopy (XPS) after 100 sheets of paper are continuously printed through the use of an image forming apparatus.

<Evaluation of Smears on Charge Roller>

After 50,000 sheets of paper were output, presence or absence of smear occurred on the surface of the charge rollers was visually observed, respectively. Table 2 shows the evaluation results. When there was no problem with smear on the charge roller, it was ranked as A. When there was a mall amount of smear found on the charge roller, it was ranked as B. When there were lots of smears found on the charge roller, it was ranked as C. When there were conspicuous smears found on the charge roller, it was ranked as D.

<Measurement of Amount of Blade Abrasion>

After 50,000 sheets of paper were output, the amount of abrasion of respective cleaning blades was measured. In the present invention, a cleaning blade resulting in an amount of blade abrasion of 10 μm or less was judged as being capable of reducing blade abrasion.

<Measurement of Amount of Abrasion of Photoconductor>

After 50,000 sheets of paper were output, the amount of abrasion of respective surfaces of photoconductors was measured. In the present invention, a photoconductor resulting in an amount of blade abrasion of the surface thereof being 61 μm or less was judged as being capable of reducing blade abrasion.

<Evaluation of Quality of Image>

Image quality of respective images after 50,000 sheets of paper being output was visually observed for evaluation. Table 2 shows the evaluation results. When there was no problem with the quality of image, it was ranked as A. When there was a small amount of streaks found on the image in low-temperature conditions, it was ranked as B. When image density was reduced, it was ranked as C. When it was a streaky image attributable to smears on the charge roller, it was ranked as D. When degradation in quality of image attributable to defective cleaning ability was found, it was ranked as E. When there were lots of streaks on the image as a whole, it was ranked as F.

TABLE 1

| | Metal-Containing Compound | | Photo- | | Image Forming | | Brush Rotation |
|---|---|---|---|---|---|---|---|
| | Metal | Content W1 (Atomic %) | conductor Type | Developer Type | Apparatus Type | Load (gf/cm$^2$) | Speed (rpm) |
| Ex. 1 | Dialkyl titanium di-thiophosphate | 3.0 | B | A | 1 | 4.8 | 155 |
| Ex. 2 | Sulfurized oxymolybdenum-dialkyl-dithiophosphate | 7.1 | B | A | 1 | 4.3 | 155 |
| Ex. 3 | Sodium palmitate | 5.3 | B | A | 1 | 4.3 | 155 |
| Ex. 4 | Calcium laurate | 3.4 | B | A | 1 | 4.3 | 155 |
| Ex. 5 | Zinc stearate | 2.4 | B | A | 1 | 4.8 | 155 |
| Ex. 6 | Manganese behenate | 2.0 | B | A | 1 | 4.8 | 155 |
| Ex. 7 | Calcium stearate | 2.4 | B | A | 1 | 4.8 | 155 |
| Ex. 8 | Calcium isostearate | 2.4 | B | A | 1 | 3.0 | 155 |
| Ex. 9 | Calcium oleate | 2.4 | B | A | 1 | 4.8 | 155 |
| Ex. 10 | Zinc isopalmitate | 2.7 | B | A | 1 | 4.8 | 155 |
| Ex. 11 | Magnesium stearate | 2.4 | B | A | 1 | 5.9 | 78 |
| Ex. 12 | Calcium stearate | 2.4 | B | A | 1 | 5.9 | 155 |
| Ex. 13 | Barium stearate | 2.4 | B | A | 1 | 5.9 | 155 |
| Ex. 14 | Aluminum stearate | 2.4 | B | A | 1 | 5.9 | 155 |
| Ex. 15 | Zinc stearate | 2.4 | A | B | 1 | 1.5 | 78 |
| Ex. 16 | Zinc stearate | 2.4 | A | B | 1 | 3.0 | 78 |
| Ex. 17 | Zinc stearate | 2.4 | A | B | 1 | 3.0 | 155 |
| Ex. 18 | Zinc stearate | 2.4 | A | B | 1 | 4.5 | 155 |
| Ex. 19 | Zinc stearate | 2.4 | A | B | 1 | 3.2 | 310 |
| Ex. 20 | Barium arachidate | 2.2 | A | B | 2 | 1.5 | 310 |
| Ex. 21 | Barium arachidate | 2.2 | A | B | 2 | 3.0 | 310 |
| Ex. 22 | Barium arachidate | 2.2 | A | B | 2 | 4.4 | 310 |
| Ex. 23 | Barium arachidate | 2.2 | A | B | 2 | 6.0 | 310 |
| Ex. 24 | Barium arachidate | 2.2 | A | B | 2 | 5.0 | 620 |
| Ex. 25 | Zinc stearate | 2.4 | A | B | 2 | 5.0 | 310 |
| Comp. Ex. 1 | Dialkyl titanium di-thiophosphate | 3.0 | B | A | 1 | 0.5 | 78 |
| Comp. Ex. 2 | Dialkyl titanium di-thiophosphate | 3.0 | B | A | 1 | 8.0 | 310 |
| Comp. Ex. 3 | Manganese behenate | 2.0 | B | A | 1 | 1.5 | 78 |
| Comp. Ex. 4 | Manganese behenate | 2.0 | B | A | 1 | 6.0 | 310 |
| Comp. Ex. 5 | Zinc stearate | 2.4 | A | B | 1 | 0.5 | 78 |
| Comp. Ex. 6 | Zinc stearate | 2.4 | A | B | 1 | 12.0 | 155 |
| Comp. Ex. 7 | Barium arachidate | 2.2 | A | B | 2 | 0.7 | 155 |
| Comp. Ex. 8 | Barium arachidate | 2.2 | A | B | 2 | 8.0 | 620 |
| Comp. Ex. 9 | Zinc stearate | 2.4 | A | B | 2 | 1.0 | 310 |
| Comp. Ex. 10 | Zinc stearate | 2.4 | A | B | 2 | 12.0 | 310 |
| Comp. Ex. 11 | None | — | B | A | 1 | — | — |
| Comp. Ex. 12 | None | — | A | B | 2 | — | — |

TABLE 2

| | Metal content: W2 (atomic %) | | Evaluation after 50,000 sheets being output | | | |
|---|---|---|---|---|---|---|
| | on surface of photoconductor after 100 sheets being printed | (W2/W1) × 100 | Smear on charge roller | Amount of blade abrasion (μm) | Amount of photoconductor abrasion (μm) | Quality of image |
| Ex. 1 | 1.3 | 43.3 | A | 4 | 5.2 | A |
| Ex. 2 | 4.3 | 60.6 | B | 8 | 4.3 | A |
| Ex. 3 | 2.6 | 49.1 | A | 3 | 3.1 | A |
| Ex. 4 | 1.9 | 55.9 | B | 8 | 3.3 | B |
| Ex. 5 | 1.1 | 45.8 | A | 3 | 4.0 | A |
| Ex. 6 | 1.0 | 50.0 | A | 4 | 3.8 | A |
| Ex. 7 | 1.0 | 41.7 | A | 4 | 3.9 | A |
| Ex. 8 | 0.6 | 25.0 | A | 3 | 5.8 | A |
| Ex. 9 | 0.8 | 33.3 | A | 3 | 3.2 | A |
| Ex. 10 | 1.3 | 48.1 | A | 5 | 3.3 | A |
| Ex. 11 | 1.1 | 45.8 | A | 6 | 4.2 | A |
| Ex. 12 | 1.0 | 41.7 | A | 4 | 3.3 | A |
| Ex. 13 | 1.2 | 50.0 | A | 4 | 4.1 | A |
| Ex. 14 | 1.1 | 45.8 | A | 3 | 4.6 | A |
| Ex. 15 | 0.4 | 16.7 | A | 2 | 2.5 | A |
| Ex. 16 | 0.7 | 29.2 | A | 4 | 1.2 | A |
| Ex. 17 | 1.0 | 41.7 | A | 5 | 0.4 | A |

TABLE 2-continued

| | Metal content: W2 (atomic %) on surface of photoconductor after 100 sheets being printed | (W2/W1) × 100 | Evaluation after 50,000 sheets being output: Smear on charge roller | Amount of blade abrasion (μm) | Amount of photoconductor abrasion (μm) | Quality of image |
|---|---|---|---|---|---|---|
| Ex. 18 | 1.4 | 58.3 | B | 7 | 0 | A |
| Ex. 19 | 1.6 | 66.7 | B | 7 | 0 | B |
| Ex. 20 | 0.3 | 13.6 | A | 2 | 2.1 | A |
| Ex. 21 | 0.5 | 22.7 | A | 3 | 1.0 | A |
| Ex. 22 | 0.7 | 31.8 | A | 5 | 0.3 | A |
| Ex. 23 | 1.2 | 54.5 | B | 8 | 0 | A |
| Ex. 24 | 1.5 | 68.2 | B | 10 | 0 | B |
| Ex. 25 | 0.6 | 25.0 | A | 3 | 0 | A |
| Compara. Ex. 1 | 0.2 | 6.7 | A | 1 | 13 | C |
| Compara. Ex. 2 | 2.9 | 96.7 | D | 28 | 0.4 | D |
| Compara. Ex. 3 | 0.1 | 5.0 | A | 2 | 12 | C |
| Compara. Ex. 4 | 2.0 | 100.0 | D | 23 | 1.2 | D |
| Compara. Ex. 5 | 0.2 | 8.3 | A | 1 | 12 | C |
| Compara. Ex. 6 | 1.8 | 75.0 | C | 19 | 0 | D |
| Compara. Ex. 7 | 0.2 | 9.1 | A | 2 | 9 | C |
| Compara. Ex. 8 | 1.8 | 81.8 | C | 20 | 0.2 | D |
| Compara. Ex. 9 | 0.1 | 4.2 | A | 3 | 10 | C |
| Compara. Ex. 10 | 2.3 | 95.8 | D | 25 | 0 | D |
| Compara. Ex. 11 | — | — | D | 25 | 16 | F |
| Compara. Ex. 12 | — | — | D | 55 | 18 | E |

Results shown in Tables 1 and 2 exemplified that results in Examples 1 to 25 in which the respective rates of variability [(W2/W1)×100] were from 10% to 70% were more capable of preventing occurrence of smear on charge rollers, reducing abrasion of blade edges, and forming excellent image in stable conditions, compared to the results in Comparative Examples 1 to 10 in which the respective rates of variability [(W2/W1)×100] were out of the range from 10% to 70%, and Comparative Examples 11 and 12 in which no metal-containing compound adhered on the surface of respective latent electrostatic image bearing members.

The latent electrostatic image bearing member of the present invention can be used for copiers, laser printers, and facsimiles for standard paper all of which directly or indirectly employ electrophotographic developing techniques. Further, it can be suitably used in image forming methods in which a latent electrostatic image bearing member used for full-color copiers, full-color laser printers, and full-color facsimiles for standard paper all of which directly or indirectly employ electrophotographic multicolor image developing techniques, in image forming methods in which the latent electrostatic image bearing member is loaded, and in a process cartridge with the latent electrostatic image bearing member held therein.

What is claimed is:

1. An image forming apparatus comprising:

a latent electrostatic image bearing member, a metal-containing compound adhesion unit configured to make a metal-containing compound adhere on the surface of the latent electrostatic image bearing member, a latent electrostatic image forming unit configured to form a latent electrostatic image on the surface of the latent electrostatic image bearing member, a developing unit configured to develop the latent electrostatic image using a toner to form a visible image, a transferring unit configured to transfer the visible image onto a recording medium, and a cleaning unit configured to clean a residual toner on the latent electrostatic image bearing member, wherein a rate of variability in the content of metallic atoms in the metal-containing compound adhered on the surface of the latent electrostatic image bearing member which is represented by the following Equation 1 is 10% to 70%

$$\text{Rate of variability}=(W2/W1)\times 100 \qquad \text{Equation 1}$$

where W1 represents the content of metallic atoms in the metal-containing compound according to x-ray photoelectron spectroscopy immediately after the metal-containing compound adhered to the surface of the latent electrostatic image bearing member by the action of the metal-containing compound adhesion unit W2 represents the content of metallic atoms in the metal-containing compound adhered on the surface of the latent electrostatic image bearing member according to x-ray photoelectron spectroscopy after 100 sheets of paper are continuously printed through the use of the image forming apparatus.

2. The image forming apparatus according to claim 1, wherein the latent electrostatic image forming unit comprises a charger configured to charge the surface of the latent electrostatic image bearing member, and an exposer configured to expose the charged surface of the latent electrostatic image bearing member to form the latent electrostatic image.

3. The image forming apparatus according to claim 1, wherein the metal-containing compound is a metallic salt of fatty acid having 12 to 18 carbon atoms.

4. The image forming apparatus according to claim 3, wherein the metal in the metallic salt of fatty acid is a metal element having coordination number of 2, and the metal element is any of the metals selected from Ba, Al, and Zn.

5. The image forming apparatus according to claim 1, wherein the metal-containing compound is a metallic salt having coordination number 2 being straight chain fatty acids, and the content of metallic atoms in the metallic salt having coordination number 2 being straight chain fatty acids adhered on the surface of the latent electrostatic image bearing member after 100 sheets of paper are continuously printed through the use of the image forming apparatus is 0.3 atomic % to 2.0 atomic %.

6. The image forming apparatus according to claim 1, wherein the latent electrostatic image bearing member is a laminar-structured photoconductive layer in which at least a charge generating layer and a charge transporting layer are formed on a substrate in this order.

7. The image forming apparatus according to claim 1, wherein the outermost surface layer of the latent electrostatic image bearing member comprises a binder resin, a charge transporting agent, and an inorganic pigment.

8. The image forming apparatus according to claim 1, wherein the image forming apparatus comprises a metal-containing compound adhesive amount adjusting unit configured to adjust the amount of the metal-containing compound to be adhered on the surface of the latent electrostatic image bearing member.

9. The image forming apparatus according to claim 1, wherein a plurality of cleaning units are arranged in the vicinity of the latent electrostatic image bearing member, and the metal-containing compound adhesion unit is arranged at the downstream side of at least one of the plurality of cleaning units.

10. The image forming apparatus according to claim 1, wherein the image forming apparatus is based on a tandem-type intermediate image transferring technique in which a plurality of image forming elements are arranged, each of the plurality of image forming elements comprises the latent electrostatic image bearing member, the metal-containing compound adhesion unit configured to make the metal-containing compound adhere on the surface of the latent electrostatic image bearing member, the latent electrostatic image forming unit configured to form the latent electrostatic image on the surface of the latent electrostatic image bearing member, the developing unit configured to develop the latent electrostatic image using the toner to form a visible image, and the transferring unit configured to transfer the visible image onto an intermediate transfer member to thereby superimpose a plurality of toner images on the intermediate transfer member.

11. The image forming apparatus according to claim 10, wherein the image forming apparatus comprises the metal-containing compound adhesion unit for intermediate transferring configured to make the metal-containing compound adhere on the surface of the intermediate transfer member, and the content of metallic atoms in the metal-containing compound adhered on the surface of the intermediate transfer member is less than that of metallic atoms in the metal-containing compound adhered on the surface of the latent electrostatic image bearing member.

12. The image forming apparatus according to claim 1, wherein the processing speed thereof is 200 mm/s or more.

13. The image forming apparatus according to claim 1, wherein the volume average particle diameter of the toner is 7 μm or less.

14. The image forming apparatus according to claim 1, wherein the average circularity of the toner is 0.97 or more.

15. An image forming method comprising:

making a metal-containing compound adhere on the surface of a latent electrostatic image bearing member, forming a latent electrostatic image on the surface of the latent electrostatic image bearing member, developing the latent electrostatic image using a toner to form a visible image, transferring the visible image onto a recording medium, and cleaning a residual toner on the latent electrostatic image bearing member, wherein a rate of variability in the content of metallic atoms in the metal-containing compound adhered on the surface of the latent electrostatic image bearing member which is represented by the following Equation 1 is 10% to 70%

$$\text{Rate of variability}=(W2/W1)\times 100 \qquad \text{Equation 1}$$

where W1 represents the content of metallic atoms in the metal-containing compound according to x-ray photoelectron spectroscopy immediately after the metal-containing compound adhered on the surface of the latent electrostatic image bearing member by the action of the metal-containing compound adhesion unit W2 represents the content of metallic atoms in the metal-containing compound adhered on the surface of the latent electrostatic image bearing member according to x-ray photoelectron spectroscopy after 100 sheets of paper are continuously printed through the use of an image forming apparatus.

16. The image forming method according to claim 15, wherein the metal-containing compound is a metallic salt having coordination number 2 being straight chain fatty acids, and the content of metallic atoms in the metallic salt having coordination number 2 being straight chain fatty acids adhered on the surface of the latent electrostatic image bearing member after 100 sheets of paper are continuously printed in accordance with the image forming method is 0.3 atomic % to 2.0 atomic %.

17. A process cartridge comprising:

a latent electrostatic image bearing member, a metal-containing compound adhesion unit configured to make a metal-containing compound adhere on the surface of the latent electrostatic image bearing member, and at least one selected from a charger, a developing unit, a transferring unit, and a cleaning unit, wherein a rate of variability in the content of metallic atoms in the metal-containing compound adhered on the surface of the latent electrostatic image bearing member which is represented by the following Equation 1 is 10% to 70%

$$\text{Rate of variability}=(W2/W1)\times 100 \qquad \text{Equation 1}$$

where W1 represents the content of metallic atoms in the metal-containing compound according to x-ray photoelectron spectroscopy immediately after the metal-containing compound adhered on the surface of the latent electrostatic image bearing member by the action of the metal-containing compound adhesion unit W2 represents the content of metallic atoms in the metal-containing compound adhered on the surface of the latent electrostatic image bearing member according to x-ray photoelectron spectroscopy after 100 sheets of paper are continuously printed through the use of an image forming apparatus with the process cartridge mounted thereon.

18. The process cartridge according to claim 17, wherein the metal-containing compound is a metallic salt having coordination number 2 being straight chain fatty acids, and the content of metallic atoms in the metallic salt having coordination number 2 being straight chain fatty acids adhered on the surface of the latent electrostatic image bearing member after 100 sheets of paper are continuously printed is 0.3 atomic % to 2.0 atomic %.

* * * * *